US007854646B2

(12) United States Patent
Togawa et al.

(10) Patent No.: US 7,854,646 B2
(45) Date of Patent: Dec. 21, 2010

(54) SUBSTRATE POLISHING APPARATUS AND SUBSTRATE POLISHING METHOD

(75) Inventors: Tetsuji Togawa, Tokyo (JP); Koichi Fukaya, Tokyo (JP); Mitsuo Tada, Tokyo (JP); Taro Takahashi, Tokyo (JP); Yasunari Suto, Tokyo (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 12/688,021

(22) Filed: Jan. 15, 2010

(65) Prior Publication Data

US 2010/0112901 A1 May 6, 2010

Related U.S. Application Data

(62) Division of application No. 10/559,135, filed as application No. PCT/JP2004/008855 on Jun. 17, 2004, now Pat. No. 7,670,206.

(30) Foreign Application Priority Data

Jun. 18, 2003 (JP) ..... 2003-174144

(51) Int. Cl.
*B24B 49/00* (2006.01)

(52) U.S. Cl. ..... 451/10; 451/11; 451/41; 451/59; 451/288; 324/229

(58) Field of Classification Search ..... 451/8, 451/10, 11, 41, 54, 59, 285, 287, 288; 324/229, 324/230, 239
See application file for complete search history.

(56) References Cited

U.S. PATENT DOCUMENTS 5,559,428 A 9/1996 Li et al.
5,643,060 A 7/1997 Sandhu et al.
5,644,221 A 7/1997 Li et al.
6,383,058 B1 5/2002 Birang et al.
6,563,308 B2 * 5/2003 Nagano et al. ..... 324/230
7,175,503 B2 * 2/2007 Lehman et al. ..... 451/5
2002/0047705 A1 * 4/2002 Tada et al. ..... 324/230
2007/0238395 A1 * 10/2007 Kimura et al. ..... 451/6
2010/0151770 A1 * 6/2010 Nakao et al. ..... 451/5

FOREIGN PATENT DOCUMENTS

JP 2002-187060 7/2002
JP 2003-106805 4/2003

OTHER PUBLICATIONS

International Search Report issued Nov. 2, 2004 in International (PCT) Application No. PCT/JP2004/008855.

* cited by examiner

*Primary Examiner*—Eileen P. Morgan
(74) *Attorney, Agent, or Firm*—Wenderoth, Lind & Ponack, L.L.P.

(57) ABSTRACT

The present invention relates to a substrate polishing apparatus and a substrate polishing method for polishing a substrate such as a semiconductor wafer to a flat finish. The substrate polishing apparatus includes a polishing table (100) having a polishing surface (101), a substrate holder (1) for holding and pressing a substrate (W) against the polishing surface (101) of the polishing table (100), and a film thickness measuring device (200) for measuring a thickness of a film on the substrate (W). The substrate holder (1) has a plurality of pressure adjustable chambers (22 to 25), and pressures in the respective chambers (22 to 25) are adjusted based on the film thickness measured by the film thickness measuring device (200).

7 Claims, 23 Drawing Sheets

FIG. 9

| DETECTION PATTERN No. | DETECTION PATTERN | DETECTION PATTERN No. | DETECTION PATTERN |
|---|---|---|---|
| 0 | EQUAL TO OR HIGHER THAN PRESET VALUE | 7 | POINT TO STOP FALLING |
| 1 | EQUAL TO OR LOWER THAN PRESET VALUE | 8 | WITHIN GRADIENT RANGE |
| 2 | MAXIMUM VALUE | 9 | GRADIENT MAXIMUM VALUE |
| 3 | MINIMUM VALUE | 10 | GRADIENT MINIMUM VALUE |
| 4 | POINT TO START INCREASING | 11 | CONVERGING IN RANGE |
| 5 | POINT TO STOP INCREASING | 12 | ALL CONVERGING IN RANGE |
| 6 | POINT TO START FALLING | | |

SUBSTRATE POLISHING APPARATUS AND SUBSTRATE POLISHING METHOD

This application is a divisional application of application Ser. No. 10/559,135,filed Feb. 11, 2008, now U.S. Pat. No. 7,670,206 which is a U.S. national stage application of International Application Serial No. PCT/JP2004/008855, filed Jun. 17, 2004.

TECHNICAL FIELD

The present invention relates to a substrate polishing apparatus and a substrate polishing method for polishing a substrate such as a semiconductor wafer to a flat finish.

BACKGROUND ART

In recent years, semiconductor devices have become smaller in size and structures of semiconductor elements have become more complicated. In addition, the number of layers in multilayer interconnects used for a logical system has been increased. Accordingly, irregularities on a surface of a semiconductor device become increased, and hence step heights on the surface of the semiconductor device tend to be larger. This is because, in a manufacturing process of a semiconductor device, a thin film is formed on a semiconductor device, then micromachining processes, such as patterning or forming holes, are performed on the semiconductor device, and these processes are repeated many times to form subsequent thin films on the semiconductor device.

When the number of irregularities on a surface of a semiconductor device is increased, a thickness of a thin film formed on a portion having a step tends to be small. Further, an open circuit is caused by disconnection of interconnects, or a short circuit is caused by insufficient insulation between interconnect layers. As a result, good products cannot be obtained, and the yield tends to be reduced. Furthermore, even if a semiconductor device initially works normally, reliability of the semiconductor device is lowered after a long-term use. At the time of exposure in a lithography process, if a surface to be irradiated has irregularities, then a lens unit in an exposure system cannot focus on such irregularities. Therefore, if the irregularities of the surface of the semiconductor device are increased, then it becomes difficult to form a fine pattern on the semiconductor device.

Accordingly, in a manufacturing process of a semiconductor device, it becomes increasingly important to planarize a surface of a semiconductor device. The most important one of the planarizing technologies is CMP (Chemical Mechanical Polishing). The chemical mechanical polishing is performed with use of a polishing apparatus. Specifically, a substrate such as a semiconductor wafer is brought into sliding contact with a polishing surface such as a polishing pad while a polishing liquid containing abrasive particles such as silica ($SiO_2$) is supplied onto the polishing surface, so that the substrate is polished.

This type of polishing apparatus comprises a polishing table having a polishing surface constituted by a polishing pad, and a substrate holding apparatus, which is called as a top ring or a carrier head, for holding a semiconductor wafer. A semiconductor wafer is polished by the polishing apparatus as follows: The semiconductor wafer is held by the substrate holding apparatus and then pressed against the polishing table under a predetermined pressure. At this time, the polishing table and the substrate holding apparatus are moved relative to each other for thereby bringing the semiconductor wafer into sliding contact with the polishing surface. Accordingly, the surface of the semiconductor wafer is polished to a flat mirror finish.

In such a polishing apparatus, if a relative pressing force between the semiconductor wafer being polished and the polishing surface of the polishing pad is not uniform over an entire surface of the semiconductor wafer, then the semiconductor wafer may insufficiently be polished or may excessively be polished at some portions depending on the pressing force applied to those portions of the semiconductor wafer. In order to avoid such a drawback, it has been attempted to form a surface, for holding a semiconductor wafer, of a substrate holding apparatus with use of an elastic membrane made of an elastic material such as rubber and apply a fluid pressure such as an air pressure to a backside surface of the elastic membrane so as to uniform a pressing force applied to the semiconductor wafer over an entire surface of the semiconductor wafer.

The polishing pad is so elastic that the pressing force applied to a peripheral portion of the semiconductor wafer tends to become non-uniform. Accordingly, only the peripheral portion of the semiconductor wafer may excessively be polished, which is called as "edge rounding". In order to prevent such edge rounding, it has been used a substrate holding apparatus in which a semiconductor wafer is held at its peripheral portion by a guide ring or a retainer ring, and the annular portion of the polishing surface that corresponds to the peripheral portion of the semiconductor wafer is pressed by the guide ring or retainer ring.

Generally, a thin film formed on a surface of a semiconductor wafer has different film thicknesses at different radial positions due to the characteristics of a method and apparatus used to form the film. Specifically, the thin film has a thickness distribution in the radial direction of the semiconductor wafer. There has been known a polishing apparatus whose substrate holding apparatus has an adjustment mechanism for adjusting pressing forces applied to a polishing surface of a polishing table, as disclosed in Japanese laid-open patent publication No. 2003-106805 and Japanese laid-open patent publication No. 2002-187060. In this kind of polishing apparatus, the substrate, to be brought into sliding contact with the polishing surface, is divided into several zones, so that the pressing forces applied to the zones of the polishing surface are adjusted by the adjustment mechanism, respectively. According to the above-mentioned polishing apparatus, it is possible to adjust the pressing force distribution in the radial direction, and hence a uniform distribution of the film thicknesses can be achieved over the entire surface of the semiconductor wafer.

However, the film thickness distribution on the surface of the semiconductor wafer varies depending on the types of method and apparatus used to form the film. Specifically, radial positions and the number of thick portions, and a difference in thickness between the thick portion and thin portion vary depending on the types of method and apparatus used to form the film. Therefore, there has been a demand to provide a substrate polishing apparatus and a substrate polishing method which can cope with various substrates having various film thickness distributions and can polish the substrates easily at a low cost, rather than a substrate polishing apparatus which can cope with only a certain substrate having a certain film thickness distribution.

DISCLOSURE OF INVENTION

The present invention has been made in view of the above drawbacks. It is an object of the present invention to provide a substrate polishing apparatus and a substrate polishing method which can appropriately polish a substrate such as a semiconductor wafer according to a thickness distribution of a film formed on a surface of the substrate so as to obtain a uniform film thickness.

In order to achieve the above object, according to one aspect of the present invention, there is provided a substrate polishing apparatus comprising: a polishing table having a polishing surface; a substrate holder for holding and pressing a substrate against the polishing surface of the polishing table; and a film thickness measuring device for measuring a thickness of a film on the substrate; wherein the substrate holder has a plurality of pressure adjustable chambers, and pressures in the respective chambers are adjusted based on the film thickness measured by the film thickness measuring device.

In a preferred aspect of the present invention, the film thickness measuring device measures the film thicknesses of a plurality of zones of the substrate corresponding to the respective chambers, and the pressures in the respective chambers are adjusted based on the film thicknesses of the respective zones measured by the film thickness measuring device.

In a preferred aspect of the present invention, the substrate polishing apparatus further comprises a storage device for storing polishing conditions each for the respective zones of the substrate; a calculating device for calculating polishing rates at the respective zones of the substrate based on the film thicknesses of the respective zones measured by the film thickness measuring device; and a correcting device for correcting the polishing conditions including the pressures in said chambers based on the calculated polishing rates.

In a preferred aspect of the present invention, the film thickness measuring device measures the thickness of the film on the substrate after the substrate is polished.

In a preferred aspect of the present invention, the film thickness measuring device measures the film thickness of the film on the substrate while the substrate is being polished.

In a preferred aspect of the present invention, the substrate is moved to pass across a detection sensor of the film thickness measuring device so that time-series data are obtained by the detection sensor; and the film thickness measuring device assigns the time-series data to the zones of the substrate so as to obtain the film thicknesses of the respective zones.

In a preferred aspect of the present invention, the film thickness measuring device comprises an eddy current sensor, an optical sensor, a temperature sensor, a torque current sensor, or a microwave sensor.

According to another aspect of the present invention, there is provided a method of polishing a substrate by pressing the substrate against a polishing surface of a polishing table, the method comprising: holding the substrate by a substrate holder which has a plurality of pressure adjustable chambers; measuring film thicknesses of a plurality of zones of the substrate corresponding to the respective chambers by a film thickness measuring device; and adjusting pressures in the respective chambers based on the measured film thicknesses of the respective zones.

In a preferred aspect of the present invention, the film thickness measuring device comprises at least one of an eddy current sensor, an optical sensor, a temperature sensor, a torque current sensor, and a microwave sensor; and the film thicknesses of the respective zones are derived from a signal or a combination of signals from at least one of the sensors suitable for the type of film on the substrate.

In a preferred aspect of the present invention, an operation mode for polishing the substrate is switched to another based on the film thicknesses measured by the film thickness measuring device.

In a preferred aspect of the present invention, an operation mode of the film thickness measuring device is switched to another based on the film thicknesses measured by the film thickness measuring device.

In a preferred aspect of the present invention, a timing to stop polishing the substrate is detected based on the film thicknesses measured by the film thickness measuring device.

In a preferred aspect of the present invention, an eddy current sensor is used as the film thickness measuring device for measuring the film thicknesses of the respective zones of the substrate; the substrate is moved to pass across a detection sensor of the film thickness measuring device so that time-series data are obtained by the detection sensor; and the time-series data are assigned to the zones of the substrate so as to obtain the film thicknesses of the respective zones.

In a preferred aspect of the present invention, the film thicknesses of the respective zones of the substrate are measured repeatedly and the pressures in said chambers are adjusted repeatedly so that the film thicknesses of the respective zones converge within a predetermined range.

According to another aspect of the present invention, there is provide a method of measuring a thickness of a film on a substrate, the method comprising: providing a sensor circuit which faces the substrate; electromagnetically coupling the substrate and the sensor circuit to each other; converting a change in impedance of the sensor circuit into a resonance frequency of the sensor circuit; measuring a change in the resonance frequency; and calculating a change in the film thickness based on the change in the resonance frequency.

According to another aspect of the present invention, there is provide a substrate polishing apparatus comprising: a polishing surface for polishing a surface of a substrate; a substrate holder for holding the substrate to bring the surface of the substrate into contact with the polishing surface; a sensor circuit disposed closely to the polishing surface; an impedance-frequency conversion circuit for converting a change in impedance of the sensor circuit into a resonance frequency of the sensor circuit and the substrate; and a frequency-thickness conversion circuit for converting a change in the resonance frequency into a thickness of a film on the surface of the substrate.

According to another aspect of the present invention, there is provide a method of measuring a thickness of a film on a substrate, the method comprising: providing a sensor circuit which faces the substrate; electromagnetically coupling the substrate and the sensor circuit to each other; measuring a change in impedance of the sensor circuit; and detecting a change in the film thickness based on the change in the impedance.

According to another aspect of the present invention, there is provide a substrate polishing apparatus comprising: a polishing surface for polishing a surface of a substrate; a substrate holder for holding the substrate to bring the surface of the substrate into contact with the polishing surface; a sensor circuit disposed closely to the polishing surface; and an impedance-thickness conversion circuit for converting a change in impedance of the sensor circuit into a thickness of a film on the surface of the substrate.

According to the present invention, the pressing forces with which the respective zones of the substrate are held in sliding contact with the polishing surface of the polishing table are adjusted according to the film thicknesses of the respective zones of the substrate. Therefore, the substrate can be polished at a desired polishing rate for each of the zones, and hence the film thickness on the substrate can be controlled with a high accuracy. It is preferable to use an eddy current sensor for measuring the film thickness while the substrate is being polished because there is no need to form an opening in the polishing surface. However, a sensor for outputting a signal representative of the thickness of the film on the substrate may be used. For example, an optical sensor, a temperature sensor, a torque current sensor, or a microwave data sensor may be used or may be combined with an eddy current sensor.

The substrate polishing apparatus according to the present invention has the substrate holder capable of adjusting the pressing forces distributed along the radial direction of the substrate and the film thickness measuring device capable of measuring the film thicknesses distributed along the radial direction. Therefore, the operation data (recipe) of the substrate holder can be automatically adjusted, and hence a uniform and stable polishing result can be achieved. Further, in a case of polishing a double-layer film comprising a Cu film and a barrier film of Ta or the like, for example, an interface between these two films can be detected by the film thickness measuring device, and hence the polishing conditions such as the pressing forces can be changed from those for the Cu film to those for the barrier film. The oscillation frequency of an oscillator of the eddy current sensor, for example, of the film thickness measuring device can be changed so as to place the film thickness measuring device itself under a condition suitable for detecting the barrier film.

BRIEF DESCRIPTION OF DRAWINGS

FIG. 9 is a table showing end point detection patterns of the film thickness measuring device of the substrate polishing apparatus;

BEST MODE FOR CARRYING OUT THE INVENTION

A substrate polishing apparatus and a substrate polishing method according to an embodiment of the present invention will be described below with reference to the accompanying drawings. FIGS. 1 through 24C show a substrate polishing apparatus which performs a substrate polishing method according to an embodiment of the present invention.

Figure 1:
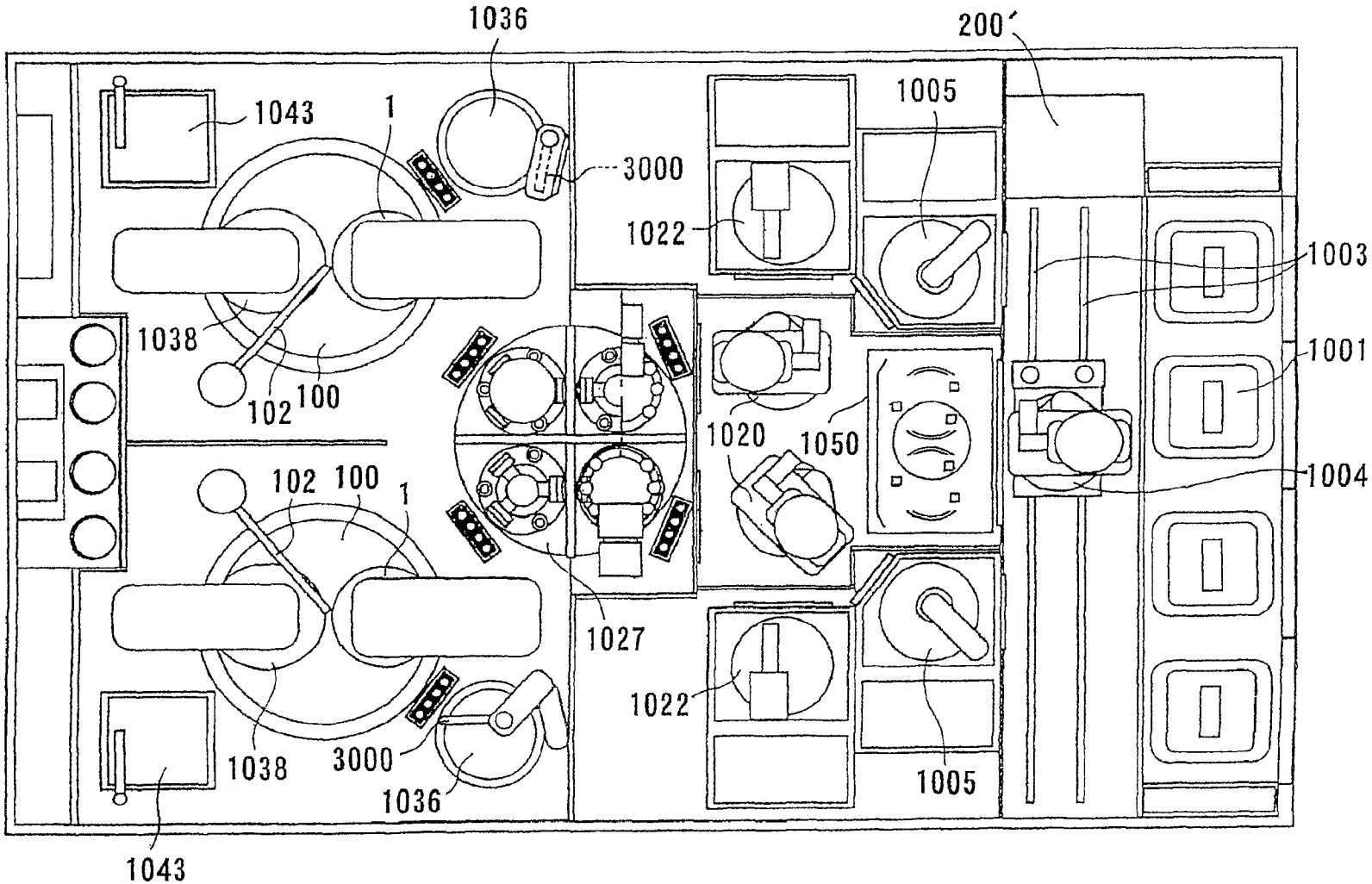
FIG. 1 is a plan view showing a substrate polishing apparatus which performs a substrate polishing method according to an embodiment of the present invention, FIG. 1 showing an arrangement of components of the substrate polishing apparatus.

FIG. 1 is a plan view showing an arrangement of the substrate polishing apparatus according to the embodiment of the present invention. The substrate polishing apparatus comprises polishing tables 100 each having a polishing surface, top rings (substrate holders) 1 each for holding a substrate to be polished and pressing the substrate against the polishing surface, and a film thickness measuring device 200' for measuring a thickness of a film formed on the substrate.

The substrate polishing apparatus comprises a transfer robot 1004 which is movable on rails 1003 for transferring a substrate such as a semiconductor wafer to and from cassettes 1001 in which substrates are housed. The substrate, which is to be polished or which has been polished, is transferred between the transfer robot 1004 and a rotary transporter 1027 via a placing table 1050 and transfer robots 1020. The substrates on the rotary transporter 1027 are held by the top ring 1 one by one and then positioned onto the polishing table 100, so that a plurality of the substrates are polished successively. As shown in FIG. 1, the substrate polishing apparatus comprises cleaning units 1005 and 1022 for cleaning and drying the substrate which has been polished. The substrate polishing apparatus also comprises polishing tables 1036 for enabling two-stage polishing, dressers 1038 and 3000 for dressing the polishing tables 100 and 1036, and water tanks 1043 for cleaning the dressers 1038.

The substrate polishing apparatus comprises an in-line type film thickness measuring device 200' for measuring a thickness of a film on a substrate (semiconductor wafer) which has been polished, cleaned, and dried. The film thickness measuring device 200' measures the film thickness before the polished substrate is stored in one of the cassettes 1001 by the transfer robot 1004 or after the substrate to be polished is removed from one of the cassettes 1001 by the transfer robot 1004, which is called as an "in-line" manner. The film thickness measuring device 200' measures the film thickness based on an eddy current signal from a sensor coil, optical signals of an incident light emitted from an optical device to the surface of the substrate and a reflected light from the surface, a signal representing a temperature of the surface of the substrate, a microwave signal reflected from the surface of the substrate, or a combination of these signals. Objects to be measured by the film thickness measuring device 200' include a conductive film such as a Cu film or a barrier layer, or an insulating film such as an oxide film on the substrate such as a semiconductor wafer. While the substrate is being polished or after the substrate is polished, the film thickness measuring device 200' detects removal of the conductive film from the substrate other than necessary areas such as interconnects or removal of the insulating film by monitoring sensor signals and measured values, so that an end point of the CMP process is determined and the appropriate CMP process is repeated.

Figure 2:
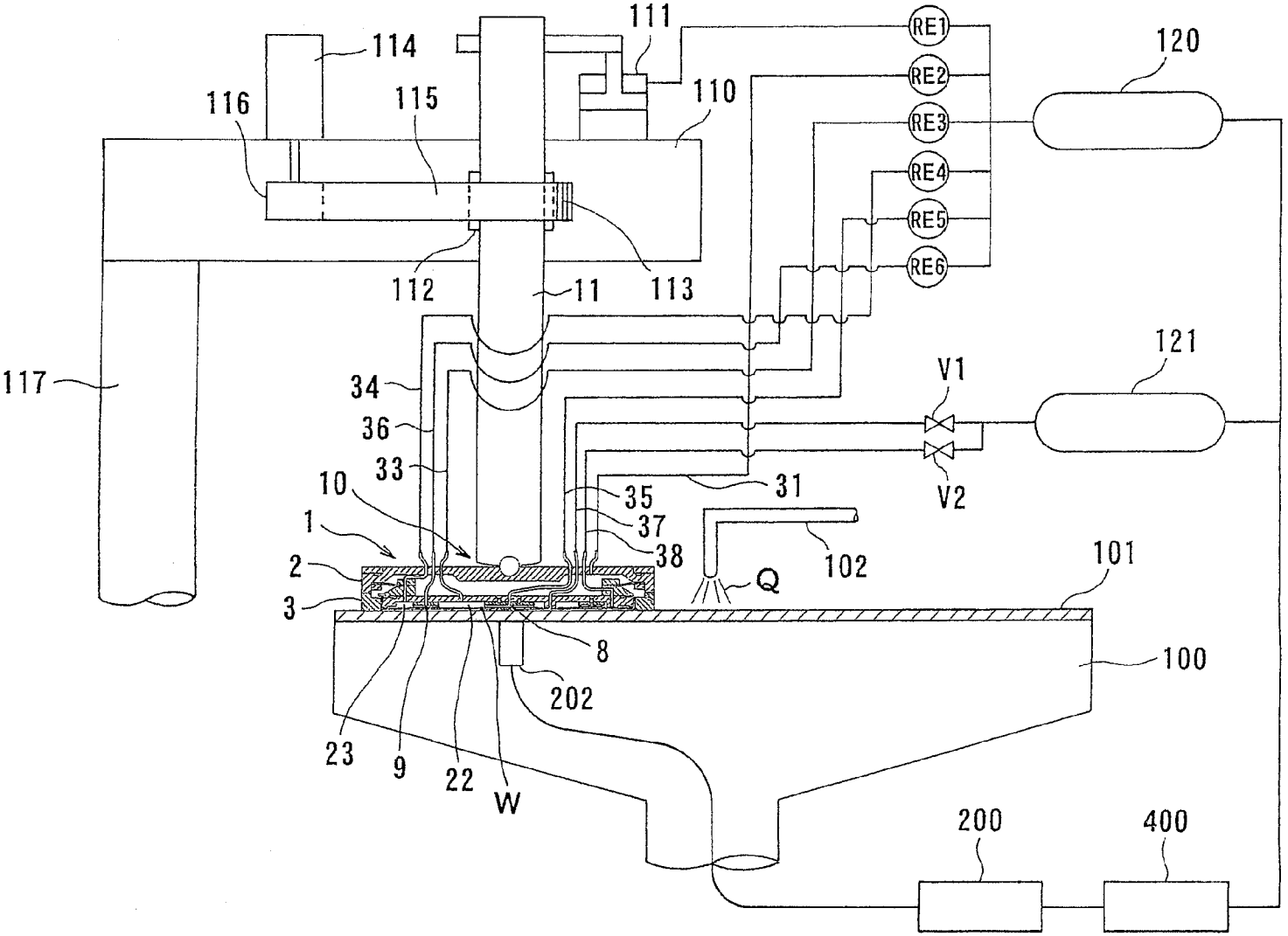
FIG. 2 is a schematic view, partly in cross section, showing a polishing table and associated components of the substrate polishing apparatus.

As shown in FIG. 2, each of the polishing tables 100 has an in-situ type film thickness measuring device 200 for measuring a thickness of a film on a substrate during polishing. The film thickness measured by the film thickness measuring device 200 is sent to a controller 400 and used for correcting operation data (recipe) of the substrate polishing apparatus. Single sensor output or a combination of the sensor outputs is used together with polishing process conditions (e.g., rotational speeds of the polishing tables 100 and the top ring 1, and the pressuring force of the top ring 1) for thereby measuring a thickness or an amount of relative change in thickness of a metal film and a non-metal film such as an oxide film during the each polishing step. The film thickness measuring device is designed to measure a thickness or an amount of change in thickness of either a thin film or a thick film. The measured value of the film thickness measuring device is used for setting various conditions of the polishing process, especially for detecting an end point of the polishing process. The film thickness measuring devices are capable of measuring the film thicknesses of radially divided zones of the substrate. The pressing forces applied to these radially divided zones of the substrate by the top ring 1 are adjusted based on the information representative of the film thicknesses that are measured in the respective zones by the film thickness measuring devices.

The top ring 1 (the substrate holder) of the substrate polishing apparatus serves to hold a substrate such as a semiconductor wafer to be polished and press the substrate against the polishing surface of the polishing table 100. As shown in FIG. 2, the polishing table 100 with a polishing pad (polishing cloth) 101 mounted on its upper surface is disposed below the top ring 1 serving as the substrate holder. A polishing liquid supply nozzle 102 is disposed above the polishing table 100 for supplying a polishing liquid Q onto the polishing pad 101 on the polishing table 100.

Various kinds of polishing pads are commercially available on the market. For example, some of these are SUBA800, IC-1000, IC-1000/SUBA400 (double-layer cloth) manufactured by Rodel, Inc., Surfin xxx-5, Surfin 000 manufactured by Fujimi Incorporated, etc. SUBA800, Surfin xxx-5, and Surfin 000 are nonwoven fabrics bound by urethane resin. IC-1000 is made of hard foam polyurethane (single-layer). Foam polyurethane is porous and has a large number of fine recesses or holes formed in its surface.

The top ring 1 is connected to a top ring drive shaft 11 by a universal joint 10, and the top ring drive shaft 11 is coupled to a top ring air cylinder 111 fixed to a top ring head 110. The top ring air cylinder 111 operates to move the top ring drive shaft 11 vertically to thereby lift and lower the top ring 1 as a whole and press a retainer ring 3 fixed to a lower end of a top ring body 2 against the polishing table 100. The top ring air cylinder 111 is connected to a pressure adjusting unit 120 via a regulator RE1. The pressure adjusting unit 120 serves to adjust a pressure by supplying a pressurized fluid such as pressurized air or developing a vacuum. Thus, the pressure adjusting unit 120 can adjust a fluid pressure of the pressurized fluid to be supplied to the top ring air cylinder 111 with the regulator RE1. Therefore, it is possible to adjust a pressing force of the retainer ring 3 which presses the polishing pad 101.

The top ring drive shaft 11 is connected to a rotary sleeve 112 by a key (not shown). The rotary sleeve 112 has a timing pulley 113 fixedly disposed on a peripheral portion thereof. A top ring motor 114 is fixed to the top ring head 110, and the timing pulley 113 is coupled to a timing pulley 116 mounted on the top ring motor 114 via a timing belt 115. Therefore, when the top ring motor 114 is energized for rotation, the rotary sleeve 112 and the top ring drive shaft 11 are rotated together with each other by the timing pulley 116, the timing belt 115, and the timing pulley 113 to thereby rotate the top ring 1. The top ring head 110 is supported by a top ring head shaft 117 which is rotatably supported by a frame (not shown).

Figure 3:
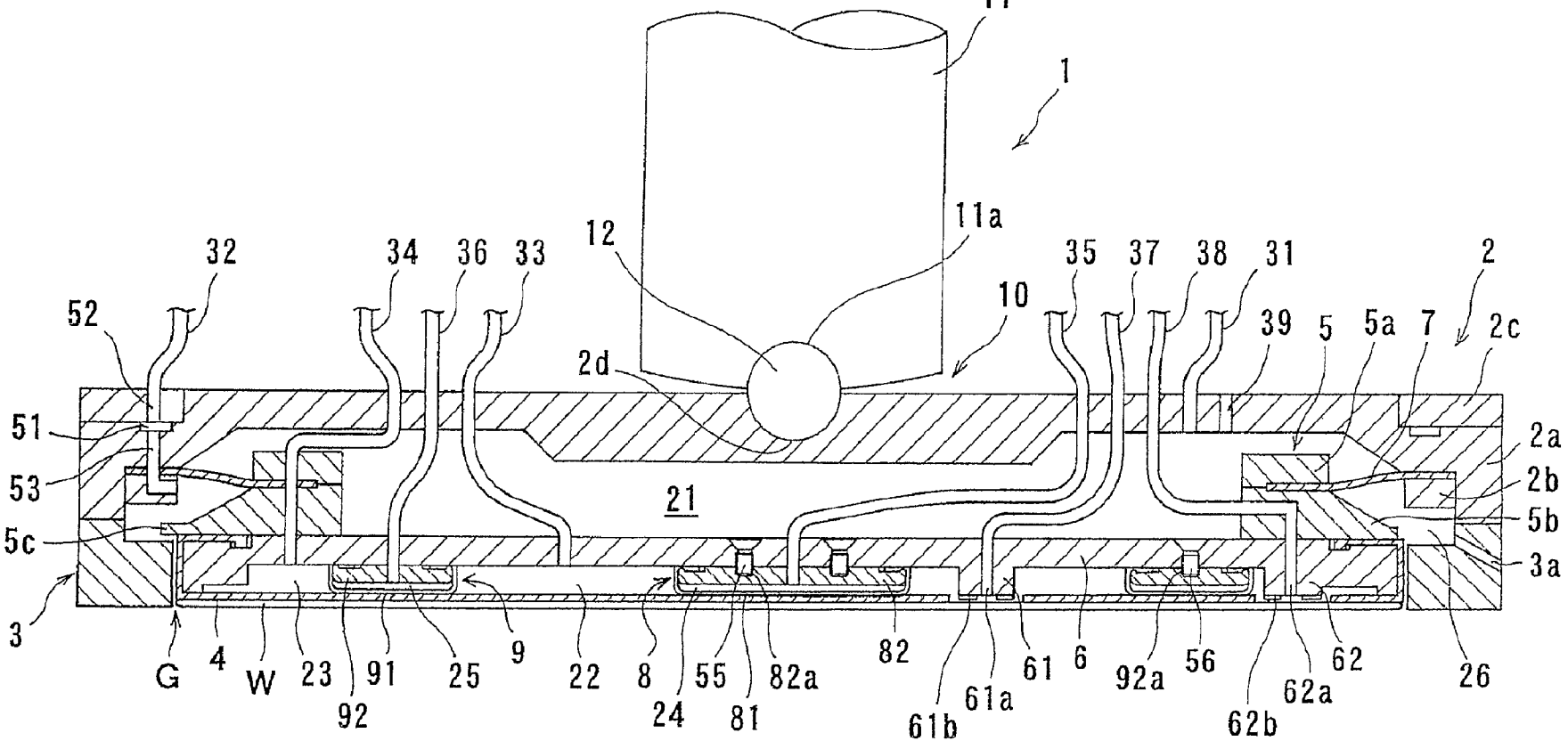
FIG. 3 is a vertical cross-sectional view showing a substrate holder of the substrate polishing apparatus.
Figure 4:
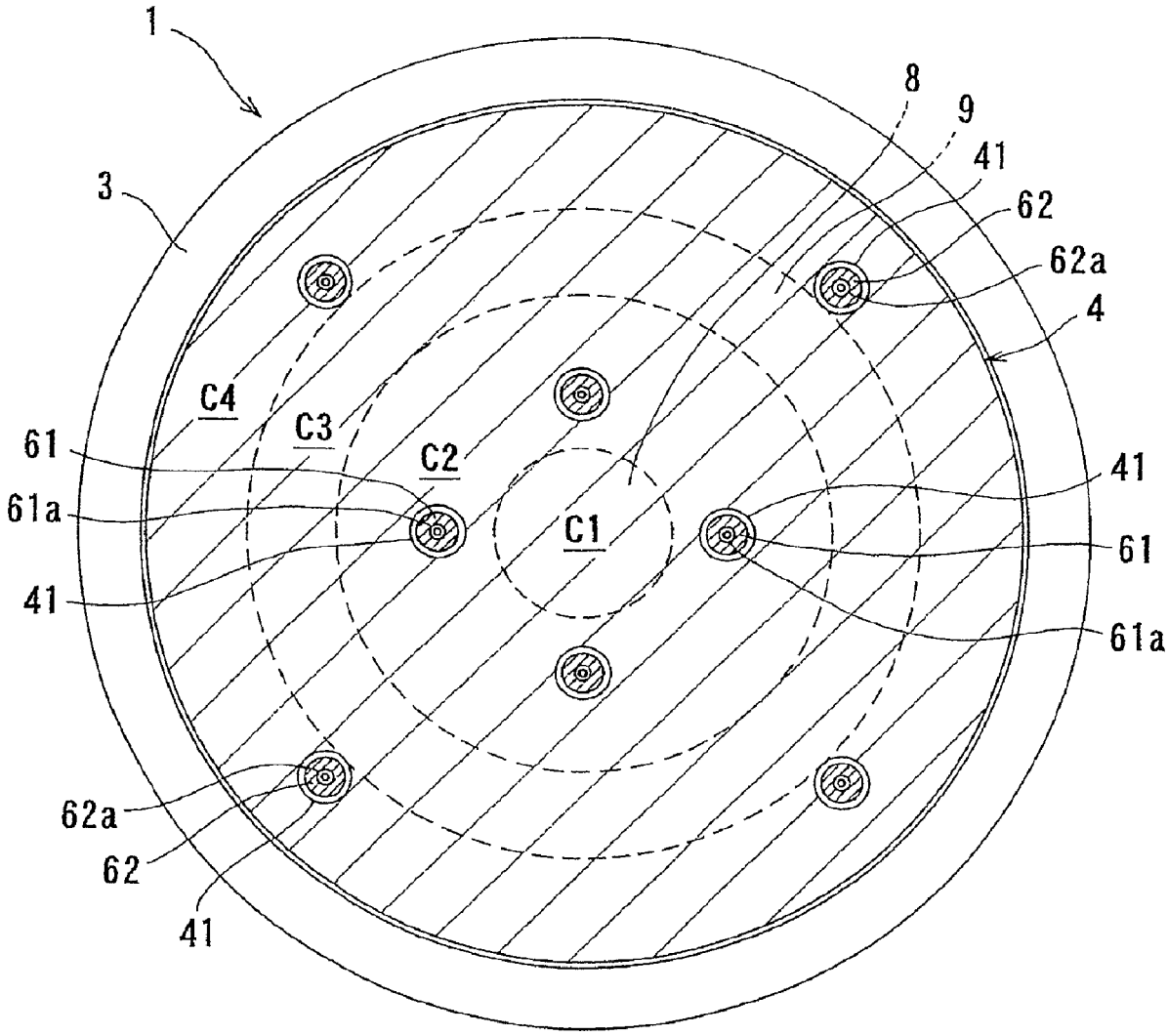
FIG. 4 is a bottom view showing the substrate holder of the substrate polishing apparatus.

The top ring 1 serving as the substrate holder will be described below in detail with reference to FIGS. 3 and 4. FIG. 3 is a vertical cross-sectional view showing the top ring 1 according to the present embodiment, and FIG. 4 is a bottom view of the top ring 1 shown in FIG. 3.

As shown in FIG. 3, the top ring 1 serving as the substrate holder comprises the cylinder-vessel-shaped top ring body 2 having a housing space therein, and the annular retainer ring 3 fixed to a lower end of the top ring body 2. The top ring body 2 is made of a highly strong and hard material such as metal or ceramics. The retainer ring 3 is made of highly hard resin, ceramics, or the like.

The top ring body 2 comprises a cylinder-vessel-shaped housing 2*a*, an annular pressurizing sheet support 2*b* fitted into an inner cylindrical portion of the housing 2*a*, and an annular seal 2*c* fitted into a groove formed in a peripheral edge of an upper surface of the housing 2*a*. The retainer ring 3 is fixed to a lower end of the housing 2*a* of the top ring body 2. The retainer ring 3 has a lower portion projecting radially inwardly. The retainer ring 3 may be formed integrally with the top ring body 2.

The top ring drive shaft 11 is disposed above the central portion of the housing 2*a* of the top ring body 2, and the top ring body 2 is coupled to the top ring drive shaft 11 by the universal joint 10. The universal joint 10 has a spherical bearing mechanism by which the top ring body 2 and the top ring drive shaft 11 are tiltable with respect to each other, and a rotation transmitting mechanism for transmitting the rotation of the top ring drive shaft 11 to the top ring body 2. The spherical bearing mechanism and the rotation transmitting mechanism transmit a pressing force and a rotating force from the top ring drive shaft 11 to the top ring body 2 while allowing the top ring body 2 and the top ring drive shaft 11 to be tilted with respect to each other.

The spherical bearing mechanism comprises a hemispherical concave recess 11*a* defined centrally in the lower surface of the top ring drive shaft 11, a hemispherical concave recess 2*d* defined centrally in the upper surface of the housing 2*a*, and a bearing ball 12 made of a highly hard material such as ceramics and interposed between the concave recesses 11*a* and 2*d*. The rotation transmitting mechanism comprises drive pins (not shown) fixed to the top ring drive shaft 11, and driven pins (not shown) fixed to the housing 2*a*. Even if the top ring body 2 is tilted with respect to the top ring drive shaft 11, the drive pins and the driven pins remain in engagement with each other while contact points are displaced because the drive pin and the driven pin are vertically movable relative to each other. Thus, the rotation transmitting mechanism reliably transmits rotational torque of the top ring drive shaft 11 to the top ring body 2.

The top ring body 2 and the retainer ring 3 integrally fixed to the top ring body 2 define a housing space therein. An elastic pad 4 which is brought into close contact with the semiconductor wafer W, an annular holder ring 5, and a disk-shaped chucking plate 6 for supporting the elastic pad 4 are disposed in the housing space. A peripheral portion of the elastic pad 4 is interposed between the holder ring 5 and the chucking plate 6 fixed to the lower end of the holder ring 5. A lower surface of the chucking plate 6 is covered with the elastic pad 4. Thus, a space is defined between the elastic pad 4 and the chucking plate 6.

The chucking plate 6 may be made of metal. However, in a case where a thickness of a thin film formed on a surface of a semiconductor wafer is measured by a method using eddy current in such a state that the semiconductor wafer to be polished is held by the top ring 1, the chucking plate 6 should preferably be made of a non-magnetic material, e.g., an insulating material. For example, a fluorine-based resin such as tetrafluoroethylene, SiC (silicon carbide), or ceramics such as $Al_2O_3$ may be used as material of the chucking plate 6.

A pressurizing sheet 7 comprising an elastic film is disposed between the holder ring 5 and the top ring body 2. An outer circumferential edge of the pressurizing sheet 7 is clamped between the housing 2*a* of the top ring body 2 and the pressurizing sheet support 2*b*, and an inner circumferential edge of the pressurizing sheet 7 is clamped between an upper end portion 5*a* and a stopper 5*b* of the holder ring 5. The top ring body 2, the chucking plate 6, the holder ring 5, and the pressurizing sheet 7 jointly define a pressure chamber 21 in the top ring body 2. As shown in FIG. 3, the pressure chamber 21 communicates with a fluid passage 31 comprising a tube, a connector, and the like. The pressure chamber 21 is connected to the pressure adjusting unit 120 via a regulator RE2 provided on the fluid passage 31. The pressurizing sheet 7 is made of a highly strong and durable rubber material such as ethylene propylene rubber (EPDM), polyurethane rubber, or silicone rubber.

In a case where the pressurizing sheet 7 is made of an elastic material such as rubber, if the pressurizing sheet 7 is fixedly clamped between the retainer ring 3 and the top ring body 2, then a desired horizontal surface cannot be maintained on the lower surface of the retainer ring 3 because of elastic deformation of the pressurizing sheet 7 as an elastic material. In the present embodiment, in order to prevent such a drawback, the pressurizing sheet 7 is clamped between the housing 2*a* of the top ring body 2 and the pressurizing sheet support 2*b* provided as a separate member. The retainer ring 3 may vertically be movable with respect to the top ring body 2, or the retainer ring 3 may have a structure capable of pressing the polishing surface independently of the top ring body 2. In such cases, the pressurizing sheet 7 is not necessarily fixed in the aforementioned manner.

A cleaning liquid passage 51 in the form of an annular groove is formed in the upper surface of the housing 2*a* at a position where the seal 2*c* of the top ring body 2 is fitted with the housing 2*a*. The cleaning liquid passage 51 communicates with a fluid passage 32 through a through-hole 52 formed in the seal 2*c*, so that a cleaning liquid such as pure water is supplied to the cleaning liquid passage 51 through the fluid passage 32. A plurality of communication holes 53 extend downwardly from the cleaning liquid passage and pass through the housing 2*a* and the pressurizing sheet support 2*b*. The communication holes 53 communicate with a small gap G between the outer circumferential surface of the elastic pad 4 and the inner circumferential surface of the retainer ring 3.

A central bag (central contact member) 8 and a ring tube 9 (outer contact member), which are be brought into contact with the elastic pad 4, are disposed in the space defined between the elastic pad 4 and the chucking plate 6. In this embodiment, as shown in FIGS. 3 and 4, the central bag 8 is disposed centrally on the lower surface of the chucking plate 6, and the ring tube 9 is disposed radially outwardly of the central bag 8 so as to surround the central bag 8. The elastic pad 4, the central bag 8, and the ring tube 9 are made of a highly strong and durable rubber material such as ethylene propylene diene monomer (EPDM), polyurethane rubber, or silicone rubber, as with the pressurizing sheet 7.

The space defined between the chucking plate 6 and the elastic pad 4 is divided into a plurality of spaces by the central bag 8 and the ring tube 9. Specifically, a pressure chamber 22 is defined between the central bag 8 and the ring tube 9, and a pressure chamber 23 is defined radially outwardly of the ring tube 9.

The central bag 8 comprises an elastic membrane 81 which is brought into contact with the upper surface of the elastic pad 4, and a central bag holder 82 for detachably holding the elastic membrane 81. The central bag holder 82 has screw holes 82*a* defined therein, and the central bag 8 is detachably fixed to the central portion of the lower surface of the chucking plate 6 by screws 55 threaded in the screw holes 82*a*. The central bag 8 has a central pressure chamber 24 defined by the elastic membrane 81 and the central bag holder 82.

Similarly, the ring tube 9 comprises an elastic membrane 91 which is brought into contact with the upper surface of the elastic pad 4, and a ring tube holder 92 for detachably holding the elastic membrane 91. The ring tube holder 92 has screw holes 92*a* defined therein, and the ring tube 9 is detachably fixed to the lower surface of the chucking plate 6 by screws 56 threaded in the screw holes 92*a*. The ring tube 9 has an intermediate pressure chamber defined by the elastic membrane 91 and the ring tube holder 92.

The pressure chambers 22 and 23, the central pressure chamber 24, and the intermediate pressure chamber 25 communicate respectively with fluid passages 33, 34, 35 and 36 each comprising a tube, a connector, and the like. The pressure chambers 22 to 25 are connected respectively to the pressure adjusting unit 120 via regulators RE3, RE4, RE5 and RE6 provided respectively on the fluid passages 33 to 36. The fluid passages 31 to 36 are connected respectively to a pure water supply source (not shown), and also connected respectively to the regulators RE2 to RE6 through a rotary joint (not shown) mounted on the upper end of the top ring shaft 11.

The pressure chamber 21 defined above the chucking plate 6 and the pressure chambers 22 to 25 are supplied with a pressurized fluid such as pressurized air or atmospheric air, or evacuated, through the fluid passages 31, 33, 34, 35 and 36 which communicate with these pressure chambers. As shown in FIG. 2, the regulators RE2 to RE6 provided on the fluid passages 31, 33, 34, 35 and 36 can regulate the pressures of the pressurized fluids supplied to the respective pressure chambers 21 to 25. The pressures in the pressure chambers 21 to 25 can thus be controlled independently of each other, or atmospheric pressure and vacuum can be produced in the pressure chambers 21 to 25. In this manner, since the pressures in the pressure chambers 21 to 25 can be changed independently of each other by the regulators RE2 to RE6, a pressing force under which the semiconductor wafer W is pressed against the polishing pad 101 by the elastic pad 4 can be adjusted in respective portions (divided zones) of the semiconductor wafer W. In some cases, these pressure chambers 21 to 25 may be connected to a vacuum source 121.

The pressurized fluid or the atmospheric air supplied to the pressure chambers 22 to 25 may be controlled in temperature, for thereby directly controlling a temperature of a workpiece such as a semiconductor wafer from a backside of a surface thereof to be polished. Particularly, when the pressure chambers are independently controlled in temperature, the rate of chemical reaction can be controlled in the chemical polishing process of CMP.

As shown in FIG. 4, the elastic pad 4 has a plurality of openings 41. Inner attraction sections 61 project downwardly from the chucking plate 6 so as to be exposed through the respective openings 41 which are positioned between the central bag 8 and the ring tube 9. Outer attraction sections 62 project downwardly from the chucking plate 6 so as to be exposed through the respective openings 41 which are positioned radially outwardly of the ring tube 9. In this embodiment, the elastic pad 4 has eight openings 41, and the attraction sections 61 and 62 are exposed through these openings 41.

Each of the inner attraction sections 61 has a communication hole 61*a* which communicates with a fluid passage 37, and each of the outer attraction sections 62 has a communication hole 62*a* which communicates with a fluid passage 38. The inner attraction sections 61 and the outer attraction sections 62 are connected to the vacuum source 121 such as a vacuum pump through the fluid passages and 38 and valves v1 and V2, respectively. When the communication holes 61*a* and 62*a* of the inner attraction sections 61 and the outer attraction sections 62 are connected to the vacuum source 121, a negative pressure is developed in open ends of the communication holes 61*a* and 62*a*, thereby attracting the semiconductor wafer W to the inner attraction sections 61 and the outer attraction sections 62. Elastic sheets 61*b* and 62*b* such as thin rubber sheets are attached to lower end surfaces of the inner attraction sections 61 and the outer attraction sections 62, respectively, so that the inner attraction sections 61 and the outer attraction sections 62 attract and hold the semiconductor wafer W softly.

As shown in FIG. 3, while the semiconductor wafer W is being polished, the inner attraction sections 61 and the outer attraction sections 62 are positioned above the lower surface of the elastic pad 4, and thus do not project from the lower surface of the elastic pad 4. When attracting the semiconductor wafer W, the lower end surfaces of the inner attraction sections 61 and the outer attraction sections 62 are positioned substantially in the same plane as the lower surface of the elastic pad 4.

Since the small gap G is formed between the outer circumferential surface of the elastic pad 4 and the inner circumferential surface of the retainer ring 3, the holder ring 5, the chucking plate 6, and components such as the elastic pad 4 that are mounted on the chucking plate 6 are vertically movable with respect to the top ring body 2 and the retainer ring 3 in a floating manner. The stopper 5*b* of the holder ring 5 has a plurality of projections 5*c* projecting radially outwardly from the outer circumferential edge of the stopper 5*b*. When the projections 5*c* engage the upper surface of the inwardly projecting portion of the retainer ring 3, a downward movement of the components including the above holder ring 5 is restricted to a predetermined position.

Operation of the top ring 1 thus constructed will be described below.

In the substrate polishing apparatus, first, the top ring 1 as a whole is moved to a transfer position of the semiconductor wafer, and then the communication holes 61*a* and 62*a* of the inner attraction sections 61 and the outer attraction sections 62 are connected to the vacuum source 121 through the fluid passages 37 and 38. The communication holes 61*a* and 62*a* are evacuated to attract the semiconductor wafer W to the lower end surfaces of the inner attraction sections 61 and the outer attraction sections 62 under vacuum. With the semiconductor wafer W being attracted to the top ring 1, the top ring 1 as a whole is moved to a position above the polishing table 100 which has the polishing surface (the polishing pad 101). The peripheral edge of the semiconductor wafer W is held by the retainer ring 3, thus preventing the semiconductor wafer W from being disengaged from the top ring 1.

When the semiconductor wafer W is polished, the semiconductor wafer W is released from the attraction sections 61 and 62, and held on the lower surface of the top ring 1. The top ring air cylinder 111 coupled to the top ring drive shaft 11 is actuated to press the retainer ring 3 fixed to the lower end of the top ring 1 against the polishing surface of the polishing table 100 under a predetermined pressing force. In this state, the pressurized fluids having respective pressures are supplied to the pressure chambers 22 and 23, the central pressure chamber 24, and the intermediate pressure chamber 25, thereby pressing the semiconductor wafer W against the polishing surface of the polishing table 100. The polishing liquid supply nozzle 102 supplies the polishing liquid Q onto the polishing pad 101, so that the polishing liquid Q is held by the polishing pad 101. Thus, the semiconductor wafer W is polished with the polishing liquid Q being present between the surface (lower surface) to be polished of the semiconductor wafer W and the polishing pad 101.

The portions of the semiconductor wafer W which are positioned respectively beneath the pressure chambers 22 and 23 are pressed against the polishing surface under the pressures of the pressurized fluid supplied to the pressure chambers 22 and 23. The portion of the semiconductor wafer W which is positioned beneath the central pressure chamber is pressed against the polishing surface through the elastic membrane 81 of the central bag 8 and the elastic pad 4 under the pressure of the pressurized fluid supplied to the central pressure chamber 24. The portion of the semiconductor wafer W which is positioned beneath the intermediate pressure chamber 25 is pressed against the polishing surface through the elastic membrane 91 of the ring tube 9 and the elastic pad 4 under the pressure of the pressurized fluid supplied to the intermediate pressure chamber 25.

Therefore, the polishing pressure applied to the semiconductor wafer W can be adjusted in the respective portions thereof that are arranged in the radial direction of the semiconductor wafer W by controlling the pressures of the pressurized fluids supplied to the pressure chambers 22 to 25. Specifically, the controller (control device) 400 controls the regulators (regulation mechanisms or adjustment mechanisms) RE3 to RE6 so as to independently regulate the pressures of the pressurized fluids supplied to the pressure chambers 22 to 25 for thereby adjusting the pressing force applied to press the semiconductor wafer W against the polishing pad 101 on the polishing table 100 in the respective portions of the semiconductor wafer W. With the polishing pressure being regulated to a desired value in each of the portions of the semiconductor wafer W, the semiconductor wafer W is pressed against the polishing pad 101 on the polishing table 100 which is being rotated. Similarly, the regulator RE1 regulates the pressure of the pressurized fluid supplied to the top ring air cylinder 111 to change the pressing force applied to the polishing pad 101 by the retainer ring 3. In this manner, while the semiconductor wafer W is being polished, the pressing force applied to the polishing pad 101 by the retainer ring 3 and the pressing force applied to press the semiconductor wafer W against the polishing pad 101 are regulated so as to provide a desired distribution of pressures which are applied respectively to a central zone (C1 in FIG. 4) of the semiconductor wafer W, an intermediate zone (C2), an outer zone (C3), a peripheral zone (C4), and the lower surface of the retainer ring 3 disposed outwardly of the semiconductor wafer W.

The semiconductor wafer W has a portion positioned beneath the pressure chambers 22 and 23. In this portion, there exist two areas. One is pressed by the pressurized fluid through the elastic pad 4, and the other is pressed directly by the pressurized fluid. The latter is an area whose position corresponds to the opening 41. These two areas may be pressed under the same pressing force, or may be pressed under the different pressing forces. Since, the elastic pad 4 is held in intimate contact with the reverse side of the semiconductor wafer W, the pressurized fluids in the pressure chambers 22 and 23 are essentially prevented from leaking through the openings 41 to the exterior.

In this manner, the semiconductor wafer W is divided into four zones comprising one circular zone and three annular zones (C1, C2, C3 and C4) which are arranged concentrically, and hence these zones (portions) can be pressed under independent pressing forces. A polishing rate depends on a pressing force applied to the surface of the semiconductor wafer W. As described above, since the pressing forces applied to these zones can be controlled, the polishing rates at the four zones (C1 to C4) of the semiconductor wafer W can be controlled independently. Therefore, even if a thin film to be polished on the surface of the semiconductor wafer W has a thickness distribution in the radial direction, the entire surface of the semiconductor wafer W is prevented from being polished insufficiently or excessively. Specifically, even if the thin film to be polished on the surface of the semiconductor wafer W has different film thicknesses distributed in the radial direction of the semiconductor wafer W, the pressure in the pressure chamber positioned above a thicker portion is set to be higher than the pressures in the other pressure chambers, or the pressure in a pressure chamber positioned above a thinner portion is set to be lower than the pressures in the other pressure chambers. Consequently, the pressing force applied to the thicker portion can be higher than the pressing force applied to the thinner portion, so that the polishing rate at the thicker portion can selectively be increased. As a result, the semiconductor wafer W can be polished uniformly over its entire surface without being affected by the film thickness distribution that has been produced when forming the film.

The circumferential edge of the semiconductor wafer W is prevented from suffering edge rounding by controlling the pressing force applied to the retainer ring 3. If the thickness of the thin film is greatly changed at the circumferential edge of the semiconductor wafer W during polishing, then the pressing force applied to the retainer ring 3 is increased or decreased intentionally for thereby controlling the polishing rate at the circumferential edge of the semiconductor wafer W. When the pressurized fluids are supplied to the pressure chambers 22 to 25, upward forces are applied to the chucking plate 6 by the pressure chambers 22 to 25. In this embodiment, the pressure chamber 21 is supplied with the pressurized fluid through the fluid passage 31 so as to prevent the chucking plate 6 from being lifted due to the forces applied by the pressure chambers 22 to 25.

As described above, the pressing force applied by the top ring air cylinder 111 to press the retainer ring 3 against the polishing pad 101 and the pressing forces applied by the pressurized fluids supplied to the pressure chambers 22 to 25 to press the respective zones of the semiconductor wafer W against the polishing pad 101 are appropriately adjusted to polish the semiconductor wafer W. When the polishing of the semiconductor wafer W is finished, the semiconductor wafer W is attracted again under vacuum to the lower end surfaces of the inner attraction sections 61 and the outer attraction sections 62. At this time, the supply of the pressurized fluids to the pressure chambers 22 to 25 for pressing the semiconductor wafer W against the polishing surface is stopped, and the pressure chambers 22 to 25 are vented to the atmosphere, thereby bringing the lower end surfaces of the inner attraction sections 61 and the outer attraction sections 62 into contact with the semiconductor wafer W. The pressure chamber 21 is vented to the atmosphere or a negative pressure is developed in the pressure chamber 21. This is because if a high pressure is maintained in the pressure chamber 21, then portions of the semiconductor wafer W which are held in contact with the inner attraction sections 61 and the outer attraction sections 62 are strongly pressed against the polishing surface. Therefore, it is necessary to quickly lower the pressure in the pressure chamber 21. As shown in FIG. 3, the top ring body 2 may have a relief port 39 communicating between the pressure chamber 21 and the atmosphere for quickly lowering the pressure in the pressure chamber 21. In this case, it is necessary to continuously supply the pressurized fluid to the pressure chamber 21 so as to keep the internal pressure of the pressure chamber 21 at a desired degree. The relief port 39 has a check valve for preventing the atmospheric air from entering the pressure chamber 21 when a negative pressure is developed in the pressure chamber 21.

After attracting the semiconductor wafer W in the manner described above, the top ring 1 as a whole is moved to the transfer position, and then a fluid (e.g., a pressurized fluid or a mixture of nitrogen and pure water) is ejected from the communication holes 61*a* and 62*a* of the inner attraction sections 61 and the outer attraction sections 62 toward the semiconductor wafer W to release the semiconductor wafer W.

The polishing liquid Q used to polish the semiconductor wafer W tends to enter the small gap G between the outer circumferential surface of the elastic pad 4 and the retainer ring 3. If the polishing liquid Q is firmly deposited in the gap G, then the holder ring 5, the chucking plate 6, and the elastic pad 4 are prevented from smoothly and vertically moving with respect to the top ring body 2 and the retainer ring 3. In order to avoid such a drawback, a cleaning liquid (pure water) is supplied to the cleaning liquid path 51 through the fluid passage 32. The pure water is supplied to the gap G through the communication holes 53, thus cleaning the gap G to prevent the polishing liquid Q from being firmly deposited in the gap G. The pure water is preferably supplied after the polished semiconductor wafer W is released and until a next semiconductor wafer to be polished is attracted to the top ring 1. As shown in FIG. 3, a plurality of through-holes 3*a* should preferably be defined in the retainer ring 3 so as to discharge all the supplied pure water before the subsequent polishing is performed. If a certain pressure is developed in a space 26 defined by the retainer ring 3, the holder ring 5, and the pressurizing sheet 7, then the chucking plate 6 is prevented from being elevated. Therefore, in order to allow the chucking plate 6 to be elevated smoothly, the above-mentioned through-holes 3*a* should preferably be provided so as to lower the pressure in the space 26 to the atmospheric pressure.

As described above, the pressing force applied to the semiconductor wafer W can be controlled by independently controlling the pressures in the pressure chambers 22 and 23, the pressure in the pressure chamber 24 in the central bag 8, and the pressure in the pressure chamber 25 in the ring tube 9. Further, with this top ring (substrate holding apparatus) 1, it is possible to easily change areas in which the pressing force is controlled by changing positions and sizes of the central bag 8 and the ring tube 9.

Specifically, a thickness distribution of a thin film formed on the surface of the semiconductor wafer varies depending on the types of method and apparatus used to form the film. With the top ring 1 according to the present embodiment, the positions and sizes of the pressure chambers for applying the pressing force to the semiconductor wafer can be changed simply by replacing the central bag 8 and the central bag holder 82, or the ring tube 9 and the ring tube holder 92. Therefore, the areas in which the pressing force is required to be controlled can be changed easily at a low cost simply by replacing only a part of the top ring 1 according to the thickness distribution of the film to be polished. In other words, it is possible to easily cope with the variation in the thickness distribution of the film on the surface of the semiconductor wafer to be polished at a low cost. When a shape and a position of the central bag 8 or the ring tube 9 are changed, the size of the pressure chamber 22 disposed between the central bag 8 and the ring tube 9 and the size of the pressure chamber 23 surrounding the ring tube 9 are also changed accordingly.

On the semiconductor wafer W to be polished by the substrate polishing apparatus, there have been formed a plated copper film for forming interconnects and a barrier layer as a base layer for the copper film. When an insulating film of silicon oxide or the like is formed on an uppermost layer of the semiconductor wafer W to be polished by the substrate polishing apparatus, an optical sensor or a microwave sensor is used to measure a thickness of the insulating film. A halogen lamp, a xenon flash lamp, an LED, a laser beam source, or the like is used as a light source of the optical sensor. In the substrate polishing apparatus, in order to remove a film such as an insulating film or a conductive film from an unnecessary area (e.g., an area other than interconnects) on the semiconductor wafer W, a sensor is used to measure a presence of the film to be polished. For example, as shown in FIG. 2, an eddy current sensor (film thickness measuring device) 200 is used to measure a thickness of a film to be polished, and the controller 400 controls a polishing process of the semiconductor wafer W based on the measured film thickness.

The process control performed by the controller 400 of the substrate polishing apparatus will be described in detail below with reference to FIGS. 5 through 9.

Figure 5:
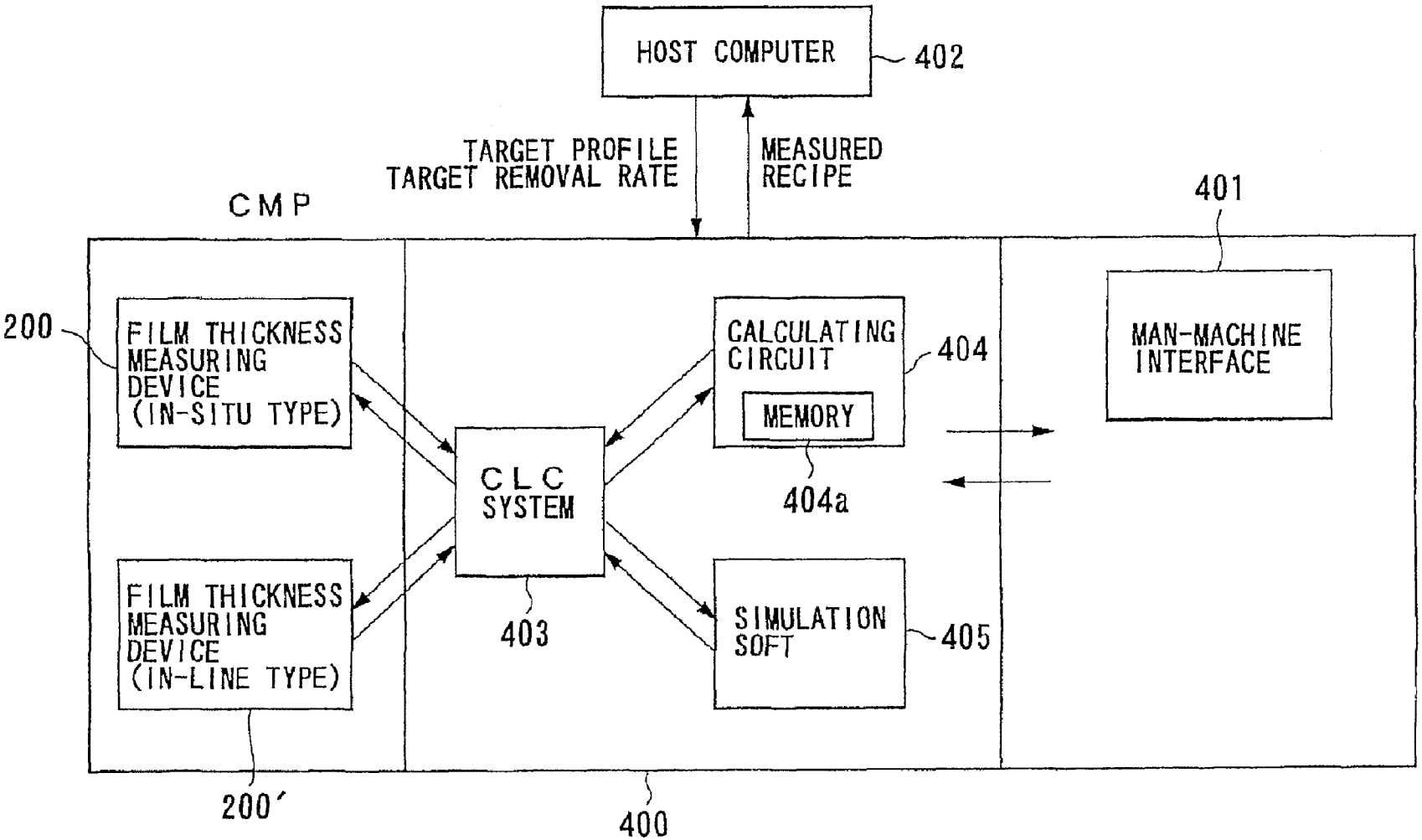
FIG. 5 is a block diagram of film thickness measuring devices and a controller of the substrate polishing apparatus.

FIG. 5 is a block diagram showing an overall arrangement of the controller. The controller 400 controls a polishing process based on a signal from a man-machine interface 401 such as an operation panel and a signal from a host computer 402 performing various data processing operations so that the semiconductor wafer W is polished at a target polishing rate to achieve a target profile, i.e., a desired shape. The controller 400 has a closed-loop control system 403 for automatically generating polishing recipes (e.g., polishing conditions) for the zones C1 to C4 of the semiconductor wafer W with use of a simulation software 405 that is stored in a hard disk drive or the like. The polishing recipes are temporarily stored in a memory (storage device) 404*a* of a calculating circuit 404, and the closed-loop control system 403 performs a polishing control according to the polishing recipes. In the polishing control, a film thickness and a polishing rate are calculated by the calculating circuit 404 based on measured values obtained by the film thickness measuring devices 200 and 200'. Thereafter, the film thickness and the polishing rate are compared with a target profile and a target polishing rate, and then a feedback process is performed to correct the polishing recipes according to the comparison results. In this manner, the controller 400 controls the substrate polishing apparatus so as to repeat the polishing of the semiconductor wafer W under the optimum conditions.

An operator can select a timing of performing the feedback process. Specifically, the feedback process can be selectively performed after or during the polishing process on the semiconductor wafer W. According to the selection, the controller 400 corrects the polishing recipes after or during the polishing process. The controller 400 may correct the polishing recipes both during and after the polishing process.

Figure 6:
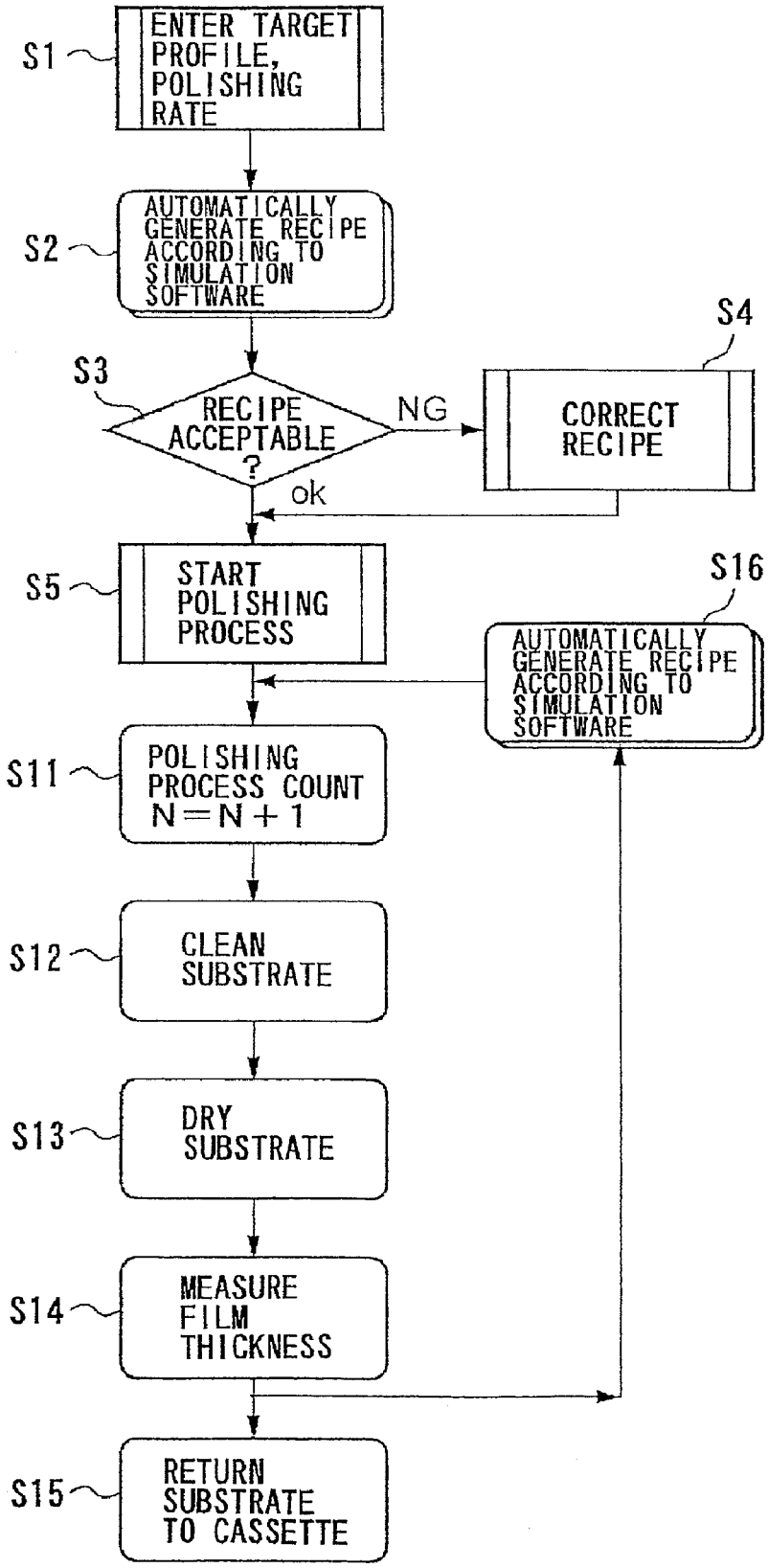
FIG. 6 is a flowchart illustrating a polishing process performed by the substrate polishing apparatus.

Specifically, as shown in FIG. 6, the operator selects and enters a dry system mode (in which a film thickness is measured after the polished semiconductor wafer W is dried) through the host computer 402, and also enters a target profile and a target polishing rate, i.e., a target removal rate (step S1). The simulation software 405 automatically generates polishing recipes (step S2). The polishing conditions according to the polishing recipes are displayed on a monitor of the host computer 402 for prompting the operator to determine whether or not the polishing recipes should to be corrected (step S3). If the polishing recipes should to be corrected, then the closed-loop control system 403 corrects the polishing recipes based on an inputted correction signal (step S4). Then, the polishing of the semiconductor wafer W is started (step S5).

The semiconductor wafer W is polished according to the polishing recipes. When the polishing process is completed, the controller 400 increments a polishing process count N by 1 (step S11). Then, the polished semiconductor wafer W is cleaned (step S12) and dried (step S13).

Thereafter, in the dry system mode, the film thickness measuring device 200' measures a thickness of the film on the semiconductor wafer W (step S14). A polishing result and an identification data which specifies the semiconductor wafer W having a polished insulating film or a polished metal film are stored. The polished semiconductor wafer W is transferred to the cassettes 1001 and then stored in one of the cassettes 1001 (step S15). Concurrent with a storing process of the semiconductor wafer W, the polishing recipes determining the polishing conditions such as polishing times and pressing forces each applied to the zones C1 to C4 of the semiconductor wafer W are corrected and automatically generated by the simulation software 405 based on the measured thickness of the polished film on the semiconductor wafer W (step S16). Then, the processing step is returned to the step S11 for polishing a next semiconductor wafer W. If the polished film such as an insulating film or a conductive film is not sufficiently removed and a part of the film remains on the semiconductor wafer W, then re-polishing conditions are generated such that only those pressure chambers whose positions correspond to the remaining film are pressurized so as to polish the remaining film, i.e., so as not to excessively polish the polished zones. The semiconductor wafer W is then polished again under the re-polishing conditions.

In the dry system mode, it is mainly required to measure the polished semiconductor wafer. Therefore, a film thickness measuring device for measuring a semiconductor wafer after the polishing but before the drying may be employed, rather than that which measures a semiconductor wafer after the drying.

Figure 7:
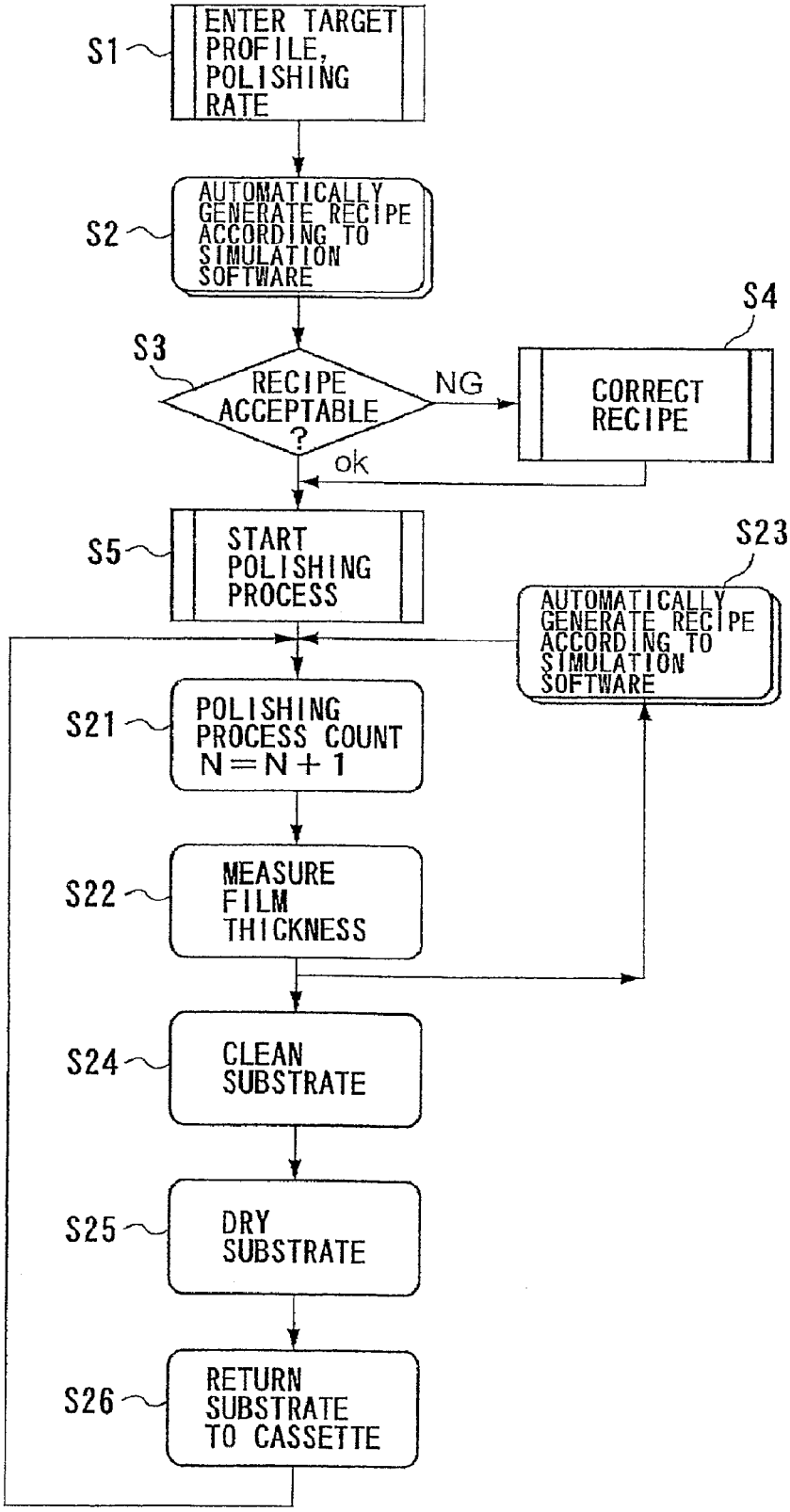
FIG. 7 is a flowchart illustrating another polishing process performed by the substrate polishing apparatus.

On the other hand, in a case where the operator selects and enters a wet system mode (in which a film thickness is measured while a semiconductor wafer is being polished in a wet state) through the host computer 402, the processing steps are performed as follows: As shown in FIG. 7, first, the operator enters a target profile and a target polishing rate (step S1). Polishing recipes are automatically generated by the simulation software 405 and the polishing process is started (steps S2 to S5). The polishing process count (recipe generation count) N is incremented by 1 during the polishing process according to the polishing recipes (step S21), and the thickness of the film on the semiconductor wafer W is measured by the eddy current sensor (the film thickness measuring device) 200, the optical sensor, or the microwave sensor (step S22).

If the polished film remains on the semiconductor wafer W to such an extent that the measurement result of the thickness of the polished film indicates a need for an additional polishing process, then new polishing recipes for correcting the polishing conditions are generated automatically by the simulation software 405 based on the measured thickness of the polished film (step S23). Thereafter, the processing step is returned to step S21 for polishing the same semiconductor wafer W again. On the other hand, if the measurement result of the thickness of the polished film indicates no need for an additional polishing process, then the polished semiconductor wafer W is cleaned (step S24) and dried (step S25). The polishing result of the polished film is stored and the semiconductor wafer W is transferred to the cassettes 1001 and stored in one of the cassettes 1001 (step S26). Then, the processing step is returned to step S11 for polishing a next semiconductor wafer W.

Figure 8:
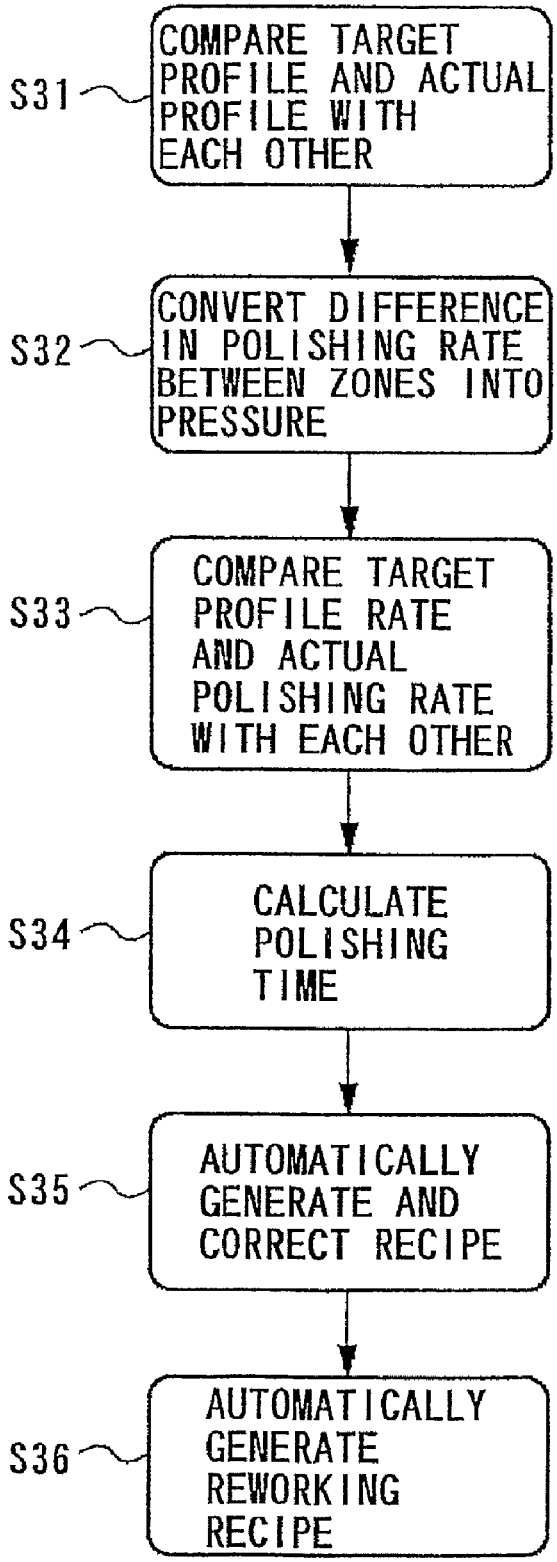
FIG. 8 is a flowchart illustrating a polishing recipe correcting process performed by the substrate polishing apparatus.

The correction of the polishing recipes by the simulation software will be described with reference to FIG. 8. A target profile and an actual profile are compared with each other (step S31), and polishing rate differences between the respective zones C1 to C4 of the semiconductor wafer W are converted into pressing force differences for those zones C1 to C4 (step S32). A target polishing rate and an actual polishing rate are compared with each other (step S33), and polishing times required to polish the respective zones C1 to C4 of the semiconductor wafer W are calculated (step S34). Polishing recipes for adjusting the pressing forces and the polishing times each for the zones C1 to C4 are automatically generated as the polishing conditions and automatically corrected to reflect such polishing conditions (step S35). Then, the corrected polishing recipes for polishing a next semiconductor wafer W are automatically generated (step S36). Consequently, the semiconductor wafer W can be polished to a radially uniform surface.

The above-mentioned film thickness measurement of the semiconductor wafer W in an in-situ manner is performed for determining whether or not the desired polishing process is completed in a particular zone or all zones C1 to C4 of the semiconductor wafer W. Therefore, various types of methods may be used to determine whether or not the desired polishing process is completed. For example, an end point of the removal process of the film or a predetermined film thickness may be determined based on a pattern of time-dependent change in a measured value using measurement results in the particular zones, measurement results in the respective zones, or an average value of those measurement results. In this case, the time-dependent change in the measured value may be first-order differentiated or n-th order differentiated for facilitating the above determination.

Specifically, the end point of the polishing process can be determined based on various timings at which the measured value or the differentiated value is changed greatly. Those timings include, as shown in FIG. 9, a timing at which the value is equal to or higher than a preset value (detection pattern No. 0), a timing at which the value is equal to or lower than a preset value (detection pattern No. 1), a timing at which the value is maximum (detection pattern No. 2), a timing at which the value is minimum (detection pattern No. 3), a timing at which the value starts increasing (detection pattern No. 4), a timing at which the value stops increasing (detection pattern No. 5), a timing at which the value starts decreasing (detection pattern No. 6), a timing at which the value stops decreasing (detection pattern No. 7). These timings are selected according to the type of film to be polished. The end point of the polishing process can also be determined based on a timing at which the differentiated value (gradient) is in a predetermined range, or is maximum or minimum (detection patterns No. 8 to No. 10). The end point of the polishing process can further be determined based on a timing at which particular measured values converge within a predetermined range (detection pattern No. 11). In order to obtain higher uniformity, the end point of the polishing process is preferably determined based on a timing at which all the measured values in all the zones C1 to C4 converge within a predetermined range (detection pattern No. 12).

The following is another example for determination.

In this example, a first-order differentiated value of a measured film thickness is used as an object to be monitored. A difference in the first-order differentiated value between a predetermined area and another area of a plurality of predesignated areas on the semiconductor wafer is calculated. The predesignated areas may be designated in a predetermined radial range or in a predetermined angular range when viewed from a reference point. Then, a timing at which the difference enters a predetermined threshold range can be determined as an end point of the polishing process. Alternatively, an integrated impedance value Sz of the eddy current sensor from a polishing start time may be calculated and compared with an integrated impedance value S0 as a reference for monitoring a polished state and detecting an end point of the polishing process. In this case, a resistance value Sx, a reactance value Sy, or an integrated film thickness St may be used instead of the integrated impedance value Sz.

By thus measuring the thickness of the film, the end point of the polishing process on a Cu layer or a barrier layer can quickly be detected during the polishing process, thus enabling immediate stop of the polishing process. In a case of polishing a tungsten (W) layer having a thickness of 1000 Å, there may be a demand for a polishing process to be changed to a low-pressure polishing process so as to achieve a lower polishing rate. Even in such a case, the eddy current sensor (described later in detail) can continuously measure an absolute film thickness of a metal layer such as a tungsten layer, the polishing process can be changed to a low-pressure polishing process by monitoring the film thickness, thereby achieving a reduction in dishing and erosion. Use of the eddy current sensor makes it possible to monitor a change in thickness of a thin barrier film or a film deposited by a CVD process, which would be difficult to be monitored with use of an in-situ type optical sensor.

The eddy current sensor can detect an end point of polishing process on a metal barrier film as long as a metal film is present as a solid film (a film covering a region in its entirety) in a region where an eddy current flows. If the measurement result of the film thickness indicates occurrence of anomaly such that in-plane uniformity is lowered or a polishing rate at a certain zone exceeds a preset limit value or limit range, it is preferable to immediately stop the polishing process. If the measurement result indicates the presence of defect such as a scratch on the semiconductor wafer, it is preferable to add the defect information to the polishing result.

As described above, according to the present embodiment, the pressing forces applied to the polishing pad can be adjusted respectively in the zones C1 to C4 of the semiconductor wafer W according to the film thicknesses in the zones C1 to C4. Accordingly, the film on the semiconductor wafer W is polished at a desired polishing rate which is adjusted based on a shape and type of the film. Therefore, the film on the semiconductor wafer W can be polished and removed with high accuracy. In a process for polishing a conductive film, an eddy current sensor (described later in detail) is suitable for use as a wet-type film thickness measuring device because there is no need for forming an opening such as a window in the polishing pad 101 and thus the semiconductor wafer W can be polished highly accurately at a low cost. However, a microwave sensor, an optical sensor, or the like may also be employed depending on the characteristics of an object to be polished.

The eddy current sensor 200 serving as the film thickness measuring device incorporated in the substrate polishing apparatus according to the present invention will be described in detail below with reference to FIGS. 10A through 24C.

Figure 10A:
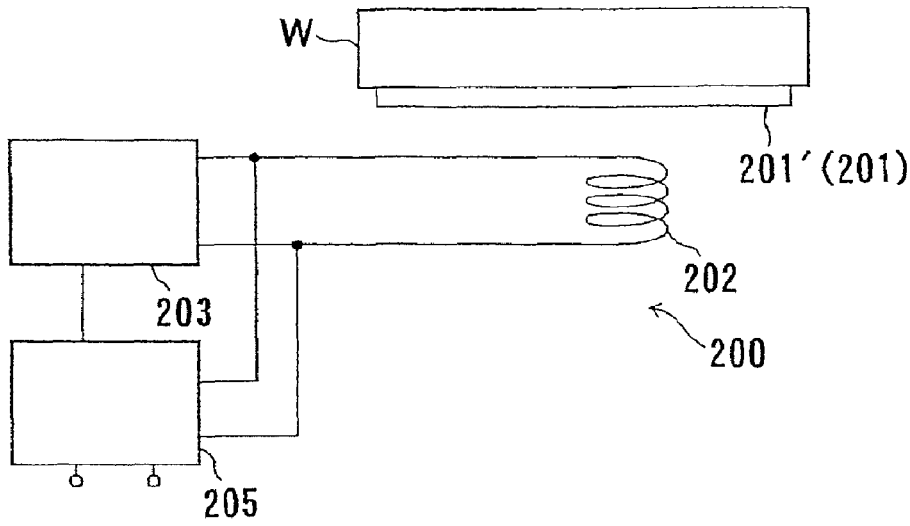
FIGS. 10A and 10B are block diagrams showing the film thickness measuring device of the substrate polishing apparatus.

As shown in FIG. 10A, the eddy current sensor (film thickness measuring device) 200 comprises a sensor coil (detection sensor) 202 disposed near a conductive film 201' to be measured, and an AC signal source 203 connected to the sensor coil 202. The conductive film 201' as an object to be measured is, for example, a plated copper film (or an evaporated film of metal such as Au, Cr, or W) formed on the semiconductor wafer W and having a thickness ranging from 0 to 1 μm, or a barrier layer formed as a base layer underneath the plated copper layer and having a thickness on the order of angstroms. The barrier layer is a high-resistance layer made of Ta, TaN, Ti, TiN, WN, or the like. It is important to measure a thickness of the barrier layer for accurately detecting an end point of the chemical mechanical polishing process. The sensor coil 202 is a detection coil disposed near the conductive film 201' and spaced from the conductive film 201' by a distance of 1.0 to 4.0 mm. Objects to be measured by the eddy current sensor includes conductive material and metal material such as Al (aluminum film), polysilicon for use in a contact plug, and CoFe and Zr (zirconia) for use in a hard disk magnetic head. A metal film formed on a semiconductor wafer, and a semiconductor substrate having metal interconnects are also objects to be measured by the eddy current sensor.

Figure 10B:
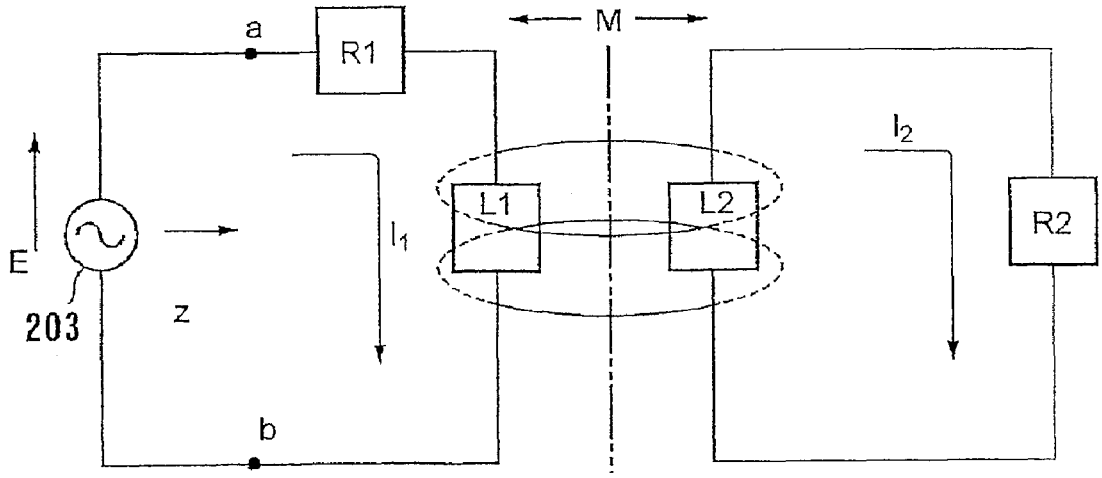

Examples of the eddy current sensor include a frequency-type eddy current sensor and an impedance-type eddy current sensor. The frequency-type eddy current sensor measures a thickness of a conductive film 201' based on a change in oscillation frequency that is caused by an eddy current induced in the conductive film 201'. The impedance-type eddy current sensor measures a thickness of the conductive film 201' based on a change in impedance. FIG. 10B shows an equivalent circuit. In the frequency-type eddy current sensor, when an eddy current $I_2$ is changed, an impedance Z is changed, thus causing a change in the oscillation frequency of the signal source (variable-frequency oscillator) 203. A detection circuit 205 detects the change in the oscillation frequency to thereby detect a change in the film thickness. In the impedance-type eddy current sensor, as shown in the equivalent circuit of FIG. 10B, when the eddy current $I_2$ is changed, the impedance Z is changed. When the impedance Z as viewed from the signal source (variable-frequency oscillator) 203 is changed, the detection circuit 205 detects the change in the impedance Z to thereby detect a change in the film thickness.

In the impedance-type eddy current sensor, signal outputs X and Y, a phase, and a combined impedance Z are derived as described later. By converting the frequency F or the impedances X and Y into a film thickness, it is possible to obtain measurement information representative of the film thickness of a metal film of Cu, Al, Au and W, a barrier film of Ta, TaN, Ti, TiN and WN, and a polysilicon film of a contact plug. These measured values may be used singly or in combination to determine an end point of a polishing process. The eddy current sensor is embedded in the polishing table 100 near its surface and faces the semiconductor wafer W to be polished through the polishing pad 101 for thereby detecting the film thickness of the conductive film on the semiconductor wafer based on an eddy current flowing through the conductive film.

The frequency of the eddy current sensor may be obtained from a single radio wave, a mixed radio wave, an AM radio wave, an FM radio wave, a sweep output of a function generator, or a plurality of oscillation frequency sources. It is preferable to select a highly sensitive oscillation frequency and modulation method according to the type of metal film to be measured.

The impedance-type eddy current sensor will be described in specific detail below. The AC signal source 203 comprises an oscillator for generating a fixed frequency in the range of 2 to 8 MHz. A crystal quartz oscillator may be used as such an oscillator. When an alternating voltage is supplied from the AC signal source 203 to the sensor coil 202, current $I_1$ flows through the sensor coil 202. When the current flows through the sensor coil 202 disposed near the conductive film 201', a magnetic flux interlinks with the conductive film 201', thus forming a mutual inductance M therebetween to induce an eddy current $I_2$ in the conductive film 201'. In FIG. 10B, R1 represents an equivalent resistance at a primary side including the sensor coil 202, and $L_1$ represents a self inductance at a primary side also including the sensor coil 202. In the conductive film 201', R2 represents an equivalent resistance corresponding to the eddy current loss, and $L_2$ represents a self inductance. The impedance Z as viewed from terminals "a" and "b" of the AC signal source 203 toward the sensor coil 202 is changed depending on the magnitude of the eddy current loss caused in the conductive film 201'.

Figure 11:
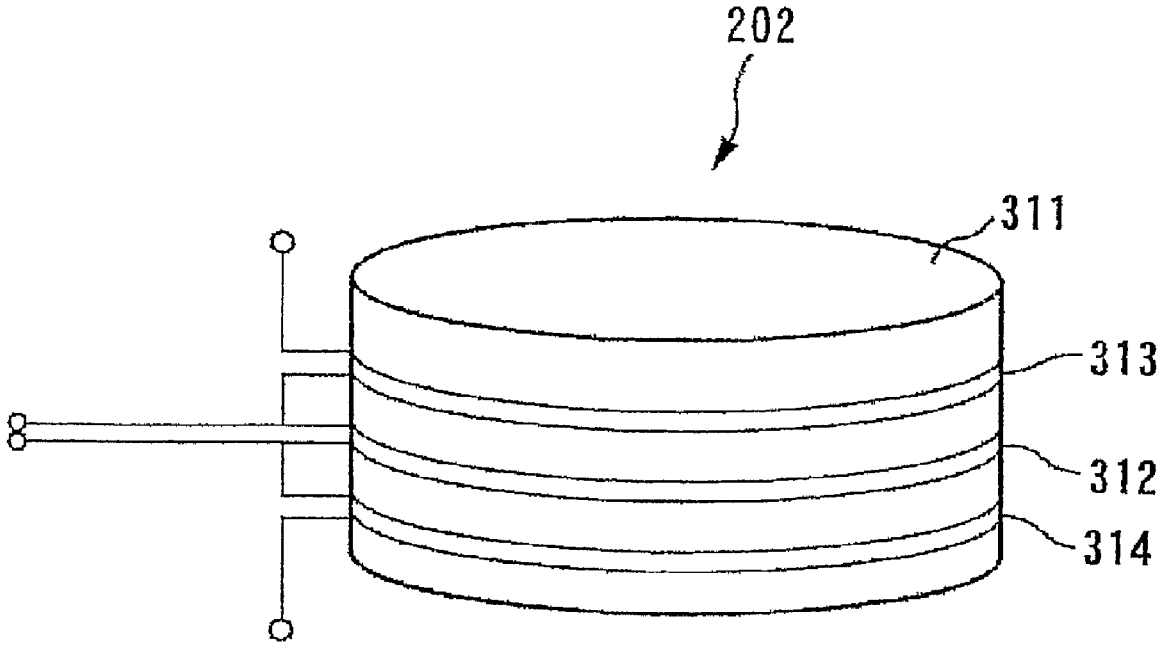
FIG. 11 is a perspective view showing a sensor coil of the film thickness measuring device of the substrate polishing apparatus.

FIG. 11 shows an arrangement of the sensor coil of the eddy current sensor according to the present embodiment. The sensor coil 202 has a coil for generating an eddy current in the conductive film, and a coil, separate from the above coil, for detecting the eddy current in the conductive film. Specifically, the sensor coil 202 comprises three coils 312, 313 and 314 wound around a bobbin 311. The central coil 312 is an oscillation coil connected to the AC signal source 203. The AC signal source 203 supplies voltage to the oscillation coil 312, and hence the oscillation coil 312 produces a magnetic field to generate an eddy current in the conductive film 201' on the semiconductor wafer W disposed near the oscillation coil 312. The detection coil 313 is disposed at an upper side of the bobbin 311 (i.e., at the conductive film 201' side), and detects a magnetic field produced by the eddy current generated in the conductive film 201'. The balancing coil 314 is disposed at the opposite side of the detection coil 313 with respect to the oscillation coil 312.

Figure 12A:
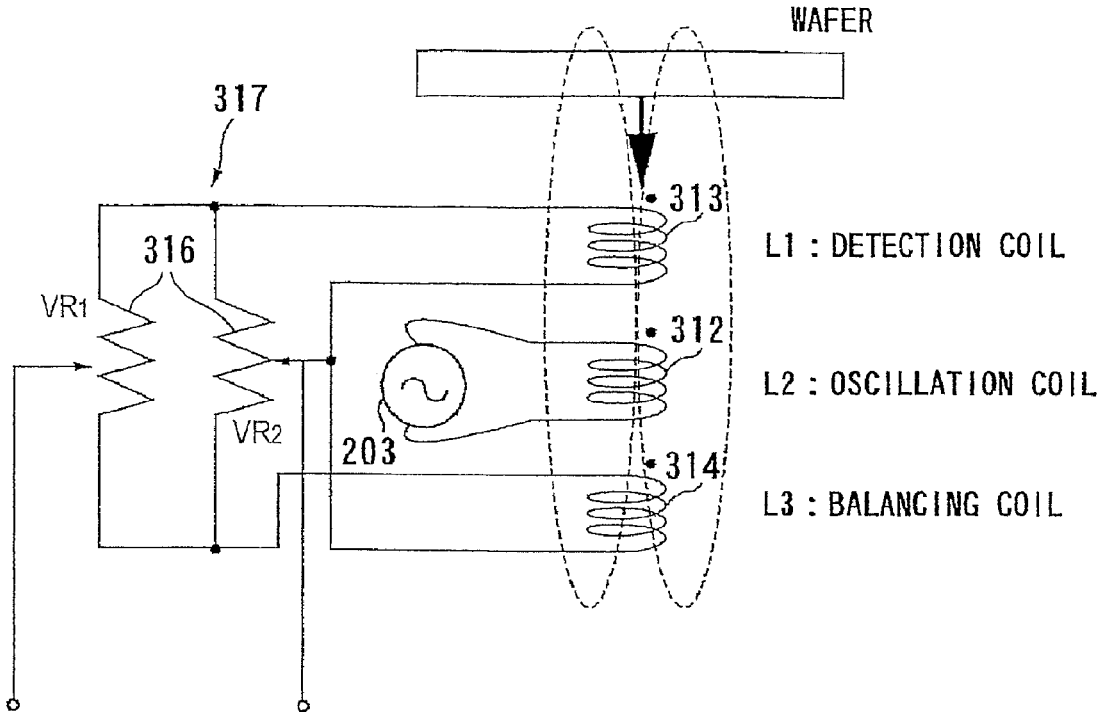
FIGS. 12A through 12C are diagrams showing a connected configuration of the sensor coil of the film thickness measuring device of the substrate polishing apparatus.
Figure 12B:
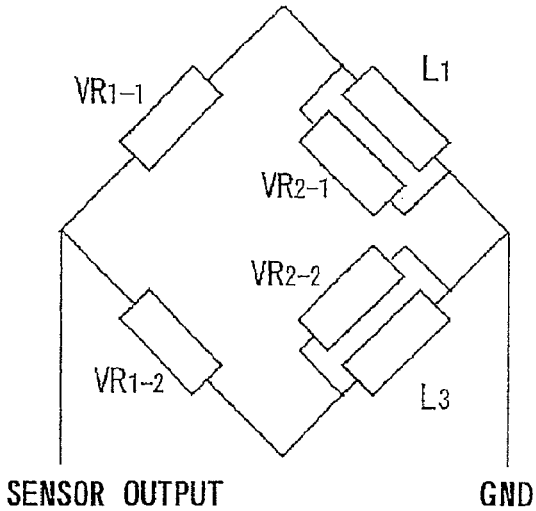
Figure 12C:
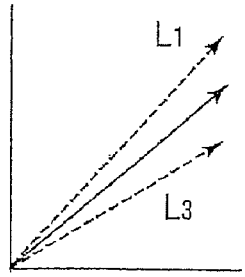

FIGS. 12A, 12B, and 12C show a connected configuration of the coils of the sensor coil. In the present embodiment, the coils 312, 313 and 314 have the same number of turns (1 to 20 turns), and the detection coil 313 and the balancing coil 314 are connected in positive-phase to each other.

The detection coil 313 and the balancing coil 314 constitute a positive-phase series circuit whose terminal ends are connected to a resistance bridge circuit 317 including variable resistors 316, as shown in FIG. 12A. The coil 312 is connected to the AC signal source 203 and thus produces an alternating magnetic flux to generate an eddy current in the conductive film 201' that is disposed closely to the coil 312. By adjusting the resistances of the variable resistors 316, an output voltage of the series circuit having the coils 313 and 314 can be adjusted such that the output voltage is zero when no conductive film is present nearby. The variable resistors 316 ($VR_1$, $VR_2$) are connected in parallel to the coils 313 and 314, and are adjusted to keep signals $L_1$ and $L_3$ in phase with each other. Specifically, in the equivalent circuit shown in FIG. 12B, the variable resistors $VR_1$ ($=VR_{1-1}+VR_{1-2}$), $VR_2$ ($=VR_{2-1}+VR_{2-2}$) are adjusted to satisfy the following equation:

$$VR_{1-1}\times(VR_{2-2}+j\omega L_3)=VR_{1-2}\times(VR_{2-1}+j\omega L_1)$$

In this manner, as shown in FIG. 12C, the signals $L_1$ and $L_3$ (indicated by the dotted lines) are transformed to have the same phase and the same amplitude as each other as indicated by the solid line.

When the conductive film is present near the detection coil 313, the magnetic flux produced by the eddy current generated in the conductive film interlinks with the detection coil 313 and the balancing coil 314. Since the detection coil 313 is positioned closer to the conductive film than the balancing coil 314, induced voltages of the coils 313 and 314 are brought out of balance, thus enabling the detection of the flux linkage produced by the eddy current flowing through the conductive film. A zero point can be adjusted by separating the series circuit having the detection coil 313 and the balancing coil 314 from the oscillation coil 312 connected to the AC signal source 203 and adjusting the balance with use of the resistance bridge circuit 317. Since the eddy current flowing through the conductive film can be detected from the zero point, the eddy current generated in the conductive film can be detected with an increased sensitivity. Therefore, a magnitude of the eddy current can be detected in a wide dynamic range.

Figure 13:
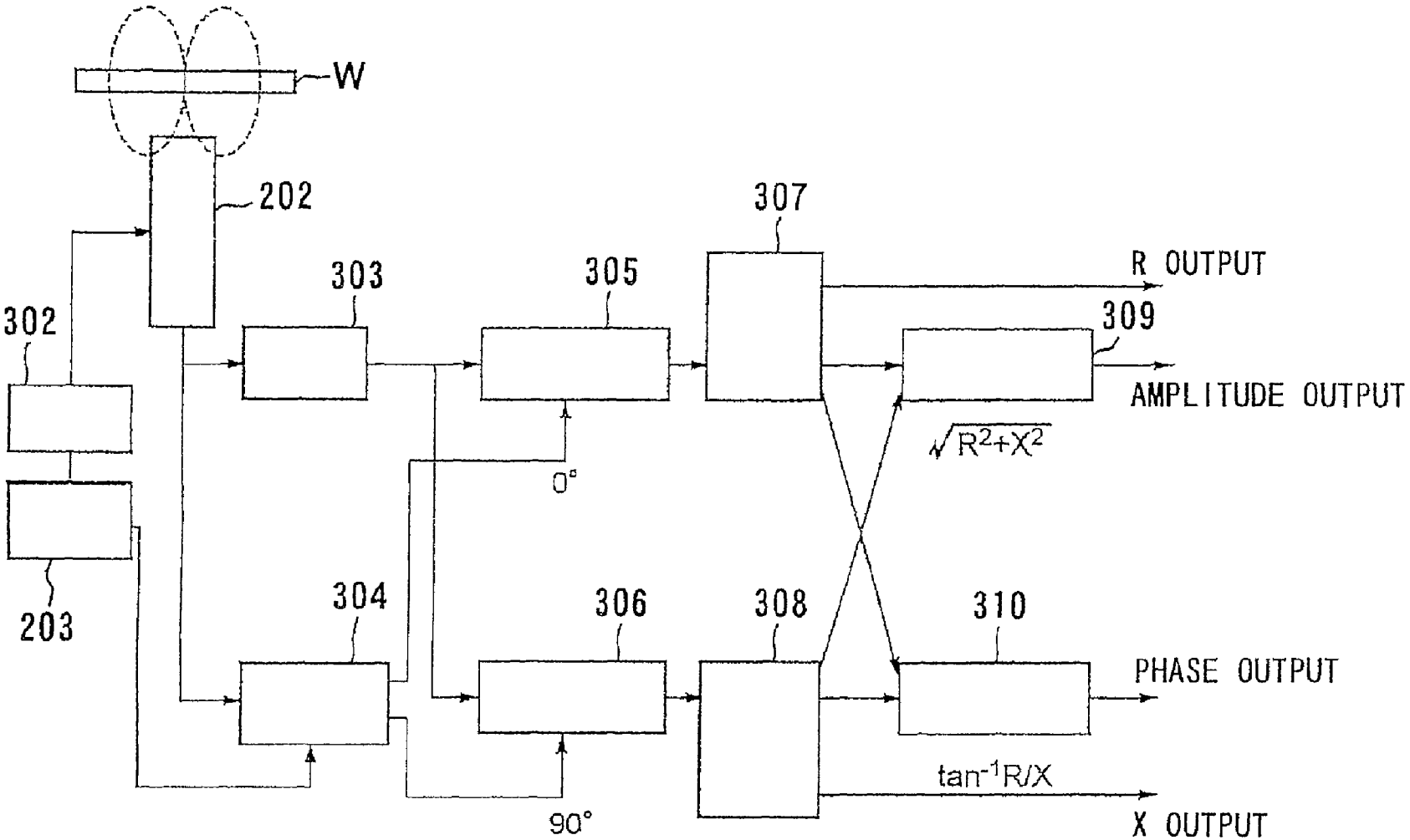
FIG. 13 is a block diagram showing a synchronous detection circuit of the film thickness measuring device of the substrate polishing apparatus.

FIG. 13 shows an example of a circuit for measuring the impedance Z as viewed from the AC signal source 203 toward the sensor coil 202. The impedance measuring circuit shown in FIG. 13 can extract a resistance component (R), a reactance component (X), an amplitude output (Z), and a phase output ($\tan^{-1}R/X$), which vary depending on the change in the film thickness. By using these four signal outputs, it is possible to detect the progress of the polishing process. For example, the film thickness can be measured based on the magnitude of the amplitude.

As described above, the AC signal source 203 supplies an AC signal to the sensor coil 202 disposed closely to the semiconductor wafer W having the conductive film 201' thereon. The AC signal source 203 comprises a fixed-frequency type oscillator such as a crystal quartz oscillator. The AC signal source 203 supplies voltage having a fixed frequency of, for example, 2 MHz or 8 MHz. The AC voltage generated by the AC signal source 203 is sent through a band-pass filter 302 to the sensor coil 202. A signal detected at the terminal of the sensor coil 202 is supplied through a high-frequency amplifier 303 and a phase shift circuit 304 to a synchronous detector comprising a cos synchronous detection circuit 305 and a sin synchronous detection circuit 306. The synchronous detector extracts a cos component and a sin component of the detected signal. The oscillation signal generated by the AC signal source 203 is supplied to the phase shift circuit 304 where the oscillation signal is resolved into two signals, i.e., an in-phase component (0°) and an orthogonal component (90°). These two signals are introduced respectively to the cos synchronous detection circuit 305 and the sin synchronous detection circuit 306, for thereby performing the above synchronous detection.

The synchronously detected signals are supplied to low-pass filters 307 and 308. The low-pass filters 307 and 308 remove unnecessary high-frequency components from the synchronously detected signals, thereby extracting a resistance component (R) as the cos synchronous detection output and a reactance component (X) as the sin synchronous detection output. A vector calculator 309 derives an amplitude $(R^2+X^2)^{1/2}$ from the resistance component (R) and the reactance component (X). A vector calculator 310 derives a phase ($\tan^{-1}R/X$) from the resistance component (R) and the reactance component (X). The film thickness measuring device has various types of filters for removing noise components from the sensor signal. These filters have their respective cutoff frequencies. For example, a low-pass filter has a cutoff frequency in the range of 0.1 to 10 Hz for removing noise components which have been mixed into the sensor signal while the semiconductor wafer is being polished. With such a low-pass filter, the film thickness can be measured with a high accuracy.

Figure 14:
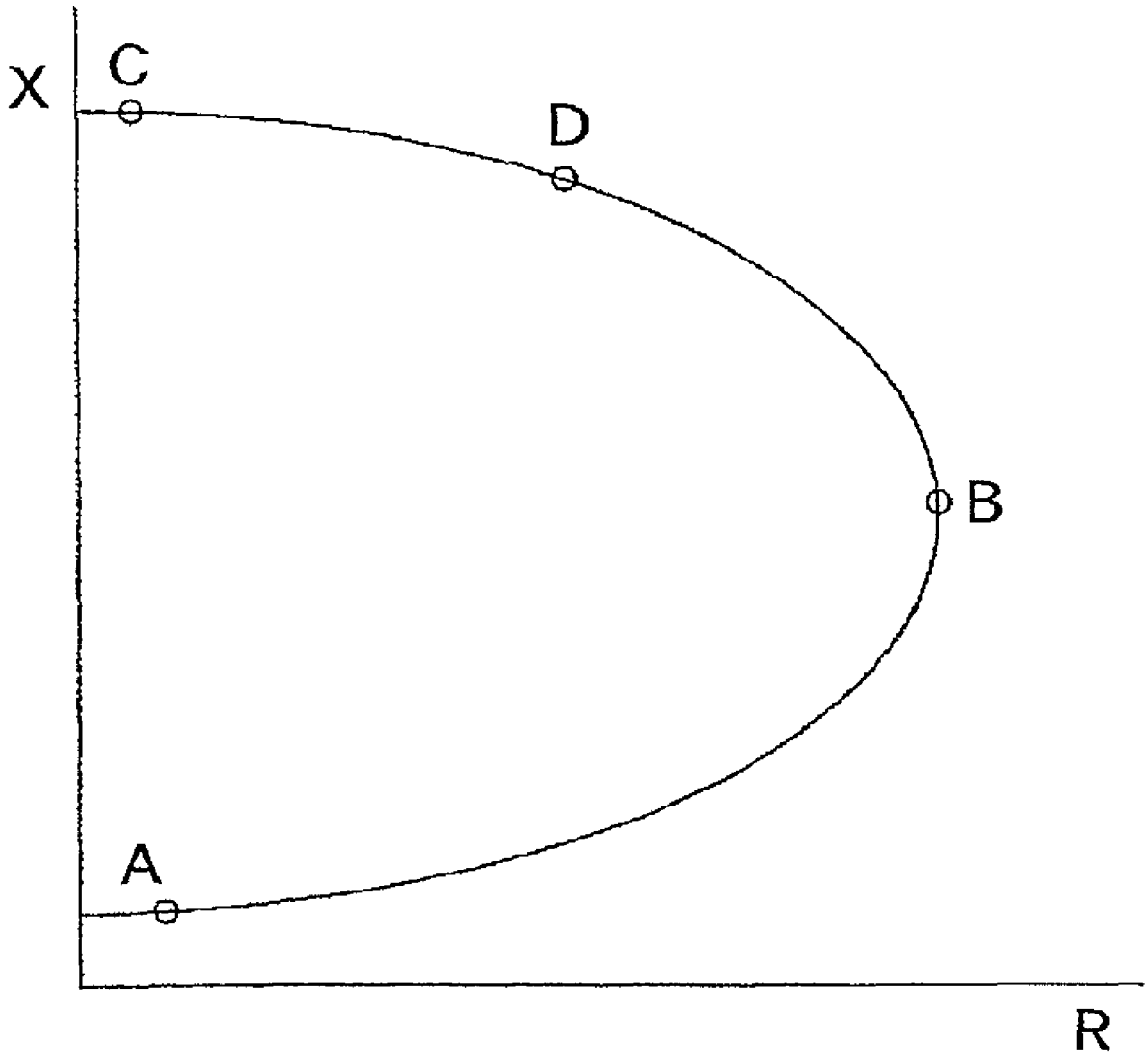
FIG. 14 is a graph showing a transition track of a resistance component (R) and a reactance component (X) in measurement of a film thickness with use of the film thickness measuring device of the substrate polishing apparatus.

FIG. 14 shows the manner in which the impedance Z as viewed from the AC signal source is changed. A horizontal axis represents the resistance component (R) and a vertical axis represents the reactance component (X). A point "A" indicates a case where the film has a very large thickness of, e.g., 100 μm or more. In this case, the impedance Z of the sensor coil 202 as viewed from the terminals "a" and "b" of the AC signal source 203 has a very small resistance component ($R_2$) and a very small reactance component $j\omega(M+L_2)$ which are connected equivalently parallel to the sensor coil 202 because the eddy current in the conductive film 201 disposed near the sensor coil 202 is very large. Therefore, both the resistance component (R) and the reactance component (X) become small.

When the conductive film becomes thin as the polishing process proceeds, the equivalent resistance component ($R_2$) and the reactance component $j\omega(M+L_2)$ of the impedance Z are increased. "B" represents a point where the resistance component (R) of the impedance Z as viewed from input terminals of the sensor coil 202 is maximum. At this point, the eddy current loss as viewed from the input terminals of the sensor coil 202 is maximum. As the polishing process further proceeds and the conductive film becomes thinner, the eddy current is reduced, and hence the resistance component (R) as viewed from the sensor coil 202 becomes smaller gradually because the eddy current loss is gradually reduced. When the conductive film is completely removed by polishing, no eddy current loss occurs and the equivalently parallel-connected resistance component ($R_2$) is increased to infinity, thus leaving only the resistance component ($R_1$) of the sensor coil 202 itself. The reactance component (X) at this time is composed only of the reactance component ($X_1$) of the sensor coil 202 itself. Such a point is represented by "C" in FIG. 14.

When forming metal interconnects in trenches defined in a silicon oxide film according to a so-called damascene process, a barrier layer of tantalum nitride (TaN), titanium nitride (TiN), or the like is formed on the silicon oxide film, and metal interconnects of copper, tungsten, or the like having a high conductivity are formed on the barrier layer. When these conductive layers are polished, it is important to detect an end point of a process of polishing the barrier layer. However, the barrier layer is a film of tantalum nitride (TaN), titanium nitride (TiN), or the like which has a relatively low conductivity and a very small thickness on the order of angstroms, as described above.

The eddy current sensor according to the present embodiment is capable of easily detecting the thickness of such a barrier layer nearly at an end point of a polishing process, and detecting the thickness of the barrier layer while being polished. The measured value of this eddy current sensor is not a relative film thickness, but an absolute film thickness. In FIG. 14, a point "D" represents a state in which the film thickness is about 1000 Å, which is reduced to zero as the polishing process proceeds. The resistance component is changed very greatly and substantially linearly as the film thickness is changed from the point D to the point C. At this period of time, the reactance component (X) is changed very little, compared with the resistance component, as shown in FIG. 14. Therefore, it is problematic for the eddy current sensor which measures a film thickness based on a change in oscillation frequency due to a change in reactance component, because such a change in the oscillation frequency is very small, compared with the change in the film thickness. Accordingly, in order to improve resolution of the change in the frequency, the frequency should be increased. However, the eddy current sensor (film thickness measuring device) 200 is capable of detecting the change in the film thickness based on the change in the resistance component while the oscillation frequency is fixed. Therefore, it is possible to clearly observe the polished state of a very small film thickness with a relatively low frequency. In the present embodiment, there is employed a method of measuring a film thickness based on the change in the resistance component which is caused by the change in the reactance component. However, depending on the object to be measured, there may be employed a method of measuring a film thickness based on the change in the oscillation frequency, or a method of measuring a film thickness based on a combined impedance of the reactance component and the resistance component.

Figure 15A:
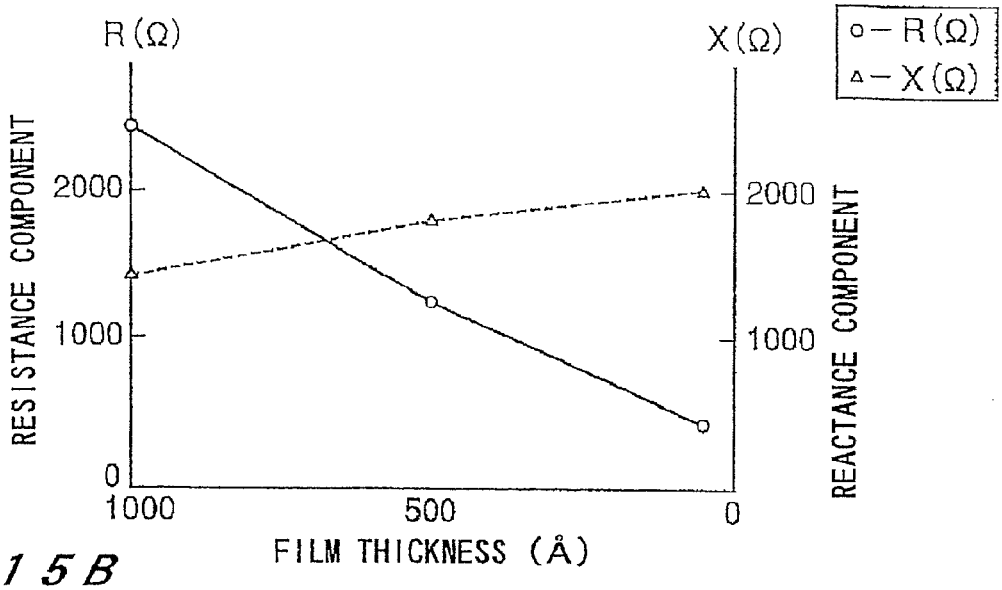
FIGS. 15A through 15C are graphs showing examples of changing manners of the resistance component (R) and the reactance component (X) in measurement of a film thickness with use of the film thickness measuring device of the substrate polishing apparatus.
Figure 15B:
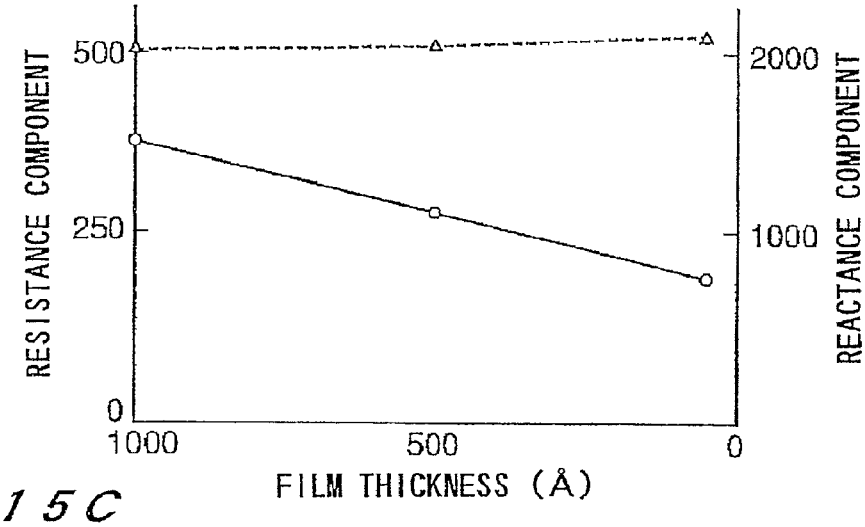
Figure 15C:
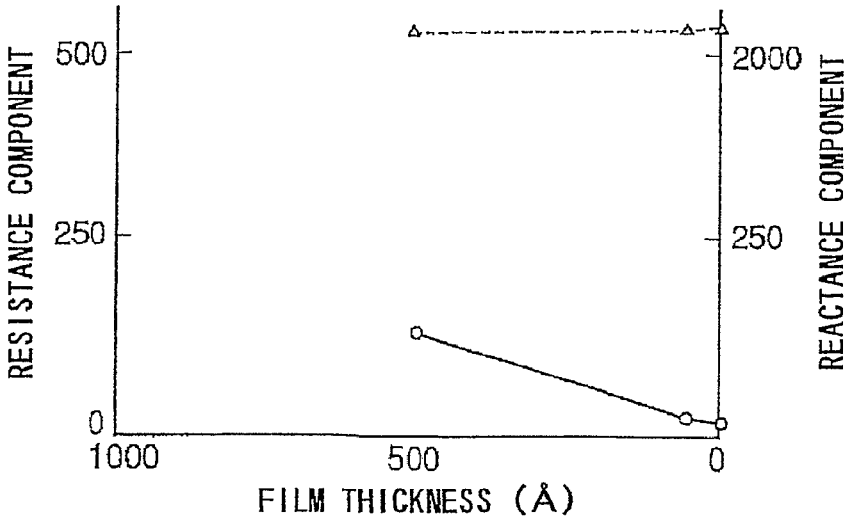

FIGS. 15A through 15C show a thickness measurement result of a thin conductive layer having a thickness on the order of angstroms. In each of FIGS. 15A through 15C, a horizontal axis represents a remaining film thickness, a left vertical axis represents a resistance component (R), and a right vertical axis represents a reactance component (X). FIG. 15A shows data of a tungsten (W) film. As can be seen from FIG. 15A, a change in the film thickness was clearly detected by observing a change in the resistance component even when the film thickness was reduced to 1000 Å or less. FIG. 15B shows data of a titanium nitride (TiN) film. As can be seen from FIG. 15B, a change in the film thickness was clearly detected even when the film thickness was reduced to 1000 Å or less. FIG. 15C shows data of a titanium (Ti) film. As can be seen from FIG. 15C, a change in the film thickness was clearly detected based on a large change in the resistance component which occurred while the film thickness was changed from 500 to 0 Å.

In each of the examples shown in FIGS. 15A through 15C, the change in the reactance component (X) is very small, compared with the change in the resistance component (R). When a thickness of a barrier layer of tantalum was changed from 250 Å to 0 Å, a rate of change in the reactance component (X) was 0.005%. In contrast thereto, a rate of change in the resistance component (R) was 1.8%. Accordingly, it can be said that the detection sensitivity was improved about 360 times the detection sensitivity of the method which observes the change in the reactance component.

When measuring a thickness of a barrier layer having a relatively low conductivity, the oscillation frequency of the AC signal source 203 should desirably be increased to a range of, for example, 8 to 16 MHz. By increasing the oscillation frequency, it is possible to clearly observe the change in the thickness of the barrier layer whose thickness is in the range of 0 to 250 Å. On the other hand, when measuring a thickness of a metal film such as a copper film having a relatively high conductivity, a change in the film thickness can clearly be detected with a low oscillation frequency of about 2 MHz. In a case of a tungsten film, the oscillation frequency of about 8 MHz is appropriate. In this manner, it is preferable to select an oscillation frequency, a degree of a sensor-amplification, and an offset value of the sensor signal according to the type of film to be polished.

The eddy current sensor 202 may comprise an eddy current sensor module which applies a certain electromagnetic field to a semiconductor wafer only when the semiconductor wafer is close to and faces the eddy current sensor embedded in the polishing table 100. Examples of such an electromagnetic field include an alternating burst electromagnetic field, a balanced-modulated electromagnetic field to which a sine wave is applied, an amplitude-modulated electromagnetic field, or a pulse-modulated electromagnetic field. Alternatively, the electromagnetic field may be continuously applied to the semiconductor wafer to measure a film thickness. In this case, when the semiconductor wafer is not close to and does not face the eddy current sensor, film thickness data predicted from data acquired in the past may be complemented so as to predict a time-dependent change in the film thickness in the future and an end point time, and compare a predicted polishing time with the actual polishing time for thereby detecting a polishing process failure or an apparatus failure. The film thickness measuring function of the eddy current sensor may be stopped or the eddy current signal may not be sampled when the semiconductor wafer is not close to or does not face the eddy current sensor, when the semiconductor wafer is not polished, or when the polishing pad is dressed.

Figure 16A:
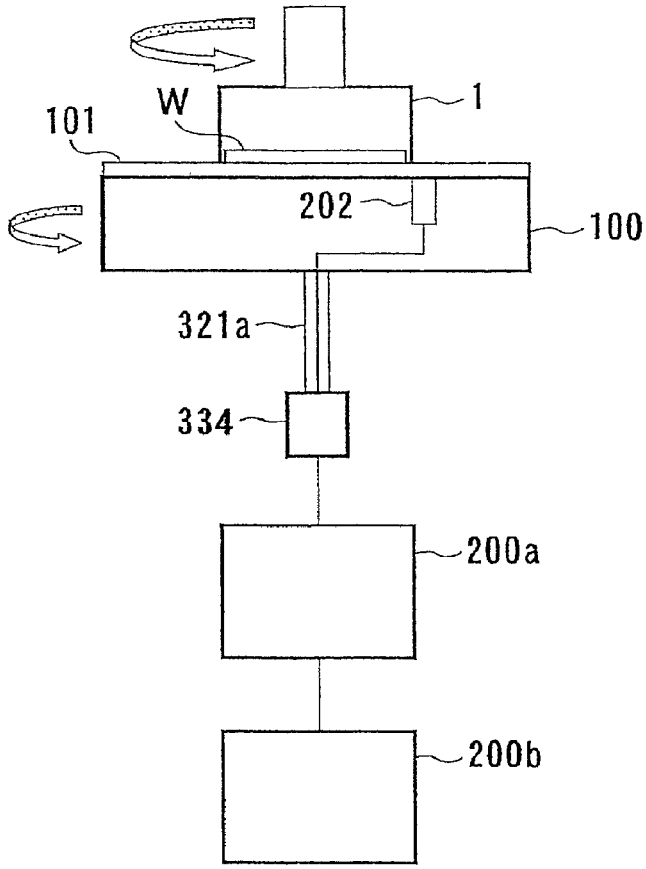
FIGS. 16A and 16B are vertical cross-sectional views showing an essential part of the substrate polishing apparatus.
Figure 17:
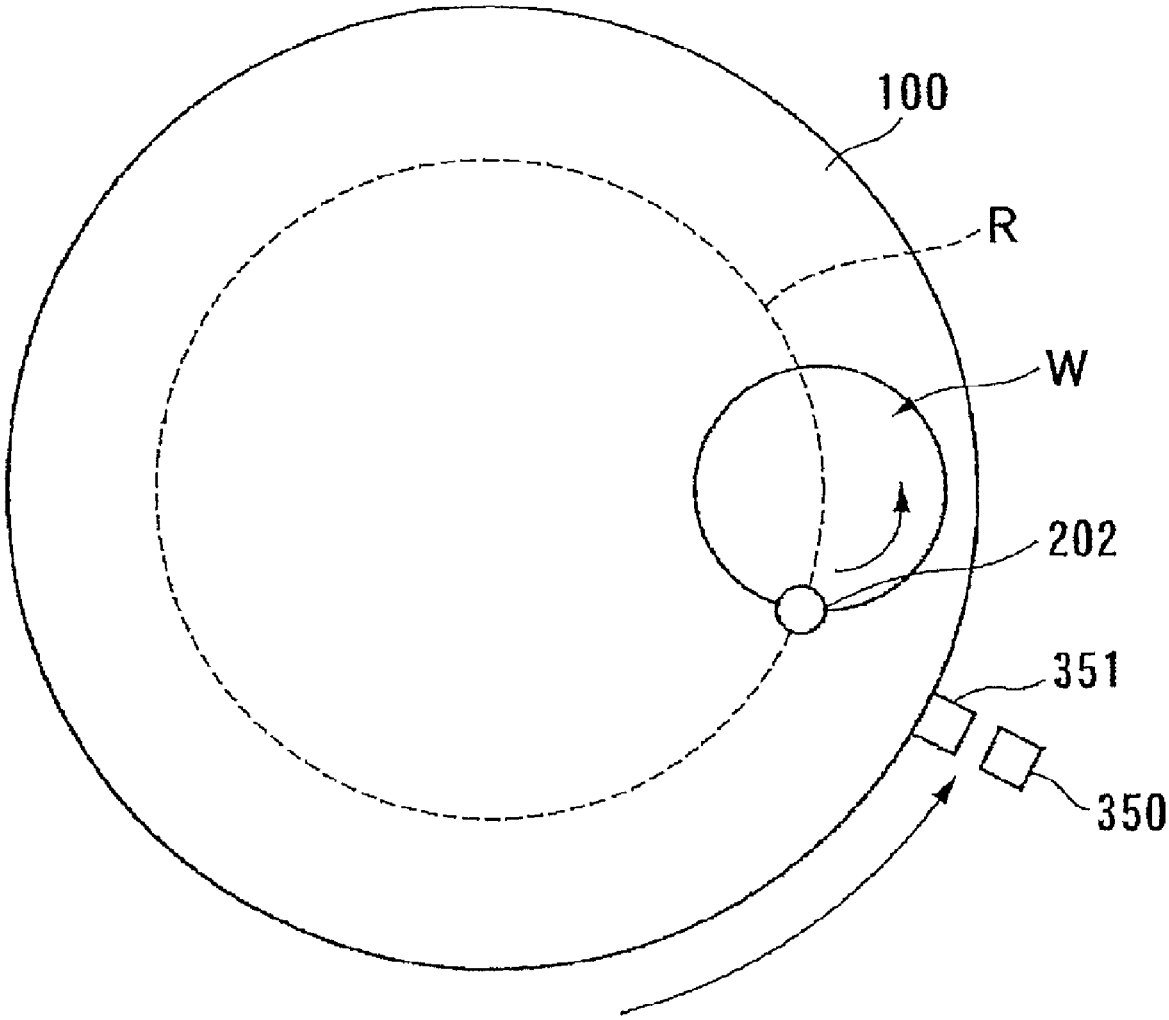
FIG. 17 is a plan view illustrating the manner in which the substrate polishing apparatus is operated.

FIG. 16A shows a vertical cross sectional view of an essential structure of the substrate polishing apparatus having the above-mentioned eddy current sensor. FIG. 17 shows a plan view of the substrate polishing apparatus having the above-mentioned eddy current sensor. As shown in FIG. 16A, the polishing table 100 is rotatable about its own axis as indicated by the arrow. The sensor coil 202 is connected to a preamplifier including the AC signal source 203 and the synchronous detection circuit 205 (see FIG. 10A). The sensor coil 202 and the preamplifier are integrally constructed and are embedded in the polishing table 100. The sensor coil 202 has a connection cable extending through a polishing table support shaft 321*a* and a rotary joint 334 mounted on a lower end of the polishing table support shaft 321*a*. The sensor coil 202 is connected to a main amplifier 200*a* and a film thickness measuring main unit (controller) 200*b* through the connection cable.

The film thickness measuring main unit 200*b* has various types of filters for removing noise components from the sensor signal. These filters have their respective cutoff frequencies. For example, a low-pass filter has a cutoff frequency in the range of 0.1 to 10 Hz for thereby removing noise components which have been mixed into the sensor signal while the semiconductor wafer is being polished. With such a low-pass filter, the film thickness can be measured with a high accuracy.

Figure 16B:
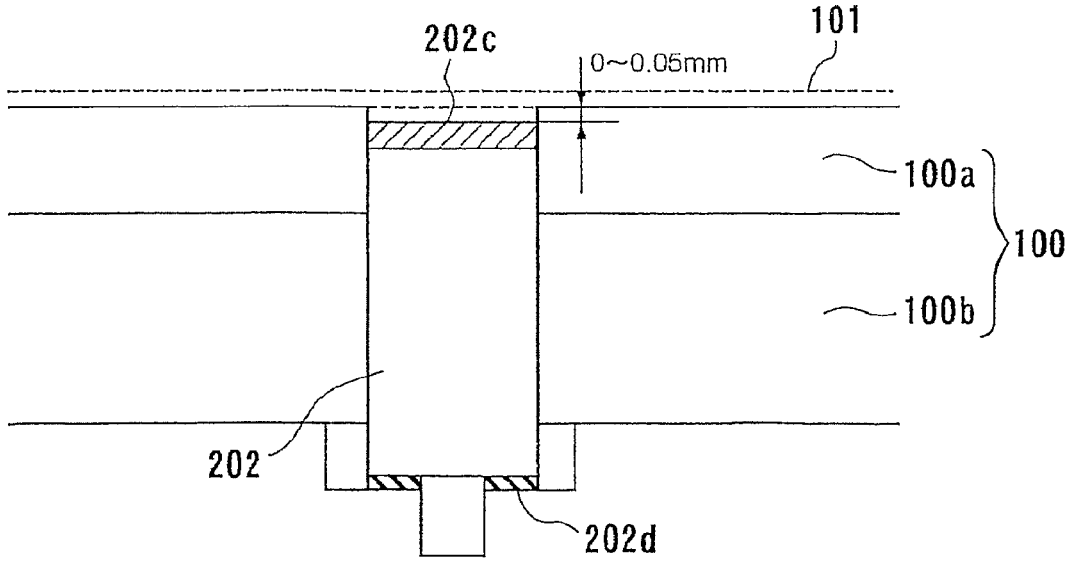

FIG. 16B shows an enlarged cross-sectional view of the eddy current sensor. A polishing-pad-side end (an upper end) of the eddy current sensor 202 has a coating member 200*c* made of a fluorine-based resin such as tetrafluoroethylene for preventing the eddy current sensor 200 from being removed from the polishing table 100 when the polishing pad 101 is removed for replacement. The polishing table 100 comprises an upper polishing table 100*a* made of SiC, and a lower polishing table 100*b* made of stainless steel. A position of the upper end of the eddy current sensor 202 is lower than a position of an upper surface (a surface facing the polishing pad 101) of the upper polishing table 100*a* by a distance ranging from 0 to 0.05 mm, so that the eddy current sensor 202 is prevented from contacting the semiconductor wafer W during a polishing process. The difference in position between the upper surface of the polishing table 100 and the upper end of the eddy current sensor 202 should be as small as possible. In the actual apparatus, the difference in position is generally set to about 0.02 mm. The position of the eddy current sensor 202 is adjusted by an adjustment mechanism such as a shim (thin plate) 202*d* or a screw.

The rotary joint 334 serves to interconnect the sensor coil 202 and the film thickness measuring main unit 200*b*. The rotary joint 334 can transmit signals through its rotating section, but has a limitation in the number of signal lines for transmitting the signals. Because of this, the signal lines to be connected to the rotary joint 334 are limited to eight signal lines, which are a DC voltage source line, an output signal line, and transmission lines for various types of control signals. The sensor coil 202 has its oscillation frequency switchable between 2 MHz and 8 MHz, and the gain of the preamplifier is also switchable according to the type of film to be polished.

As shown in FIG. 17, when the polishing table 100 is rotated, a dog 351 mounted on an outer circumferential edge of the polishing table 100 is detected by a dog sensor 350. When the film thickness measuring main unit 200*b* receives a detected signal from the dog sensor 350, the film thickness measuring main unit 200*b* is started to measure the semiconductor wafer W held by the top ring 1. As the polishing table 100 is rotated, the sensor coil 202 traces a path R passing across the semiconductor wafer W.

Figure 18:
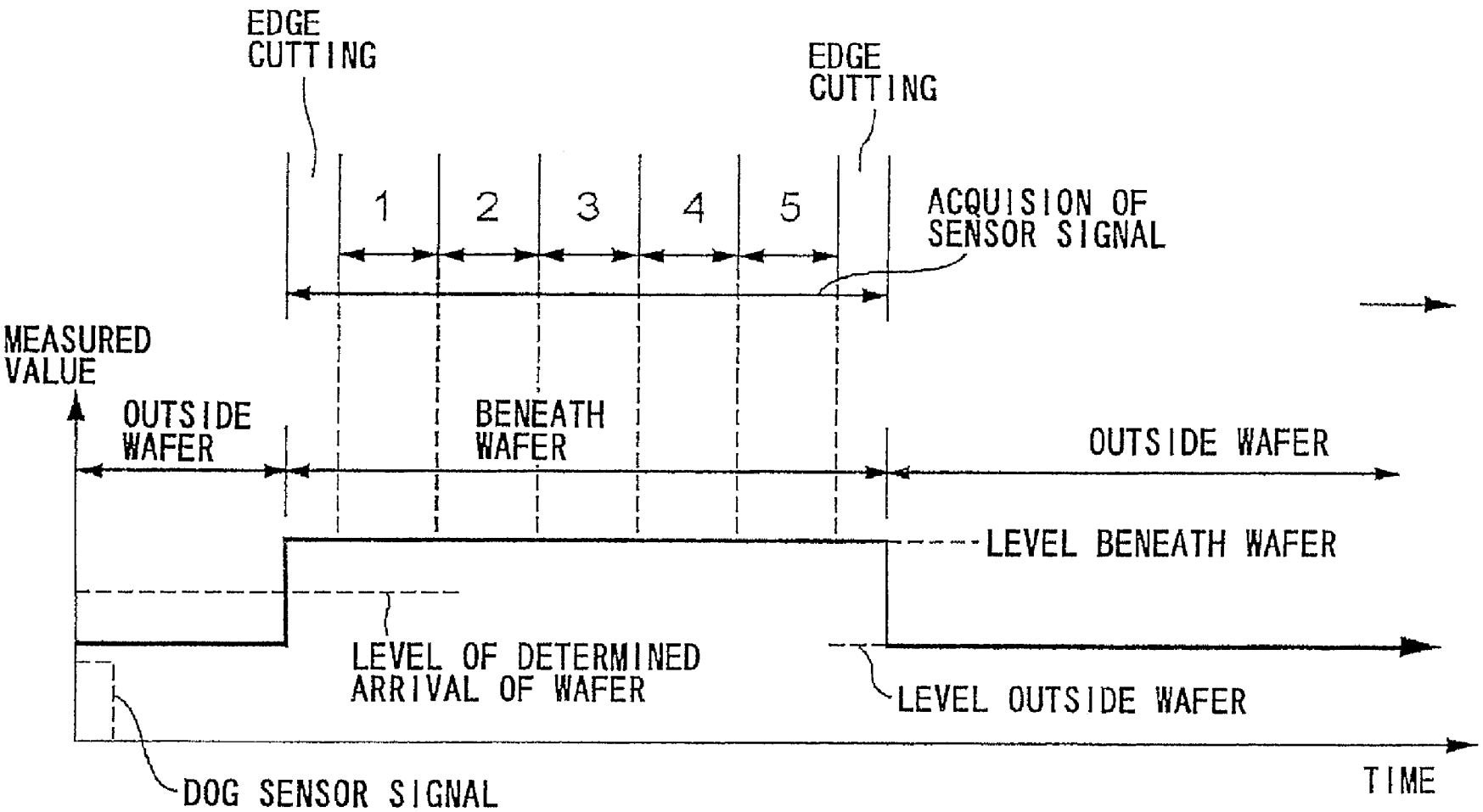
FIG. 18 is a graph illustrating a sensor signal of the film thickness measuring device of the substrate polishing apparatus.

As shown in FIG. 18, when the polishing table 100 makes one revolution, the film thickness measuring main unit 200*b* receives a signal from the dog sensor 350. At this time, since the semiconductor wafer W does not arrive at a position above the sensor coil 202, the film thickness measuring main unit 200*b* receives a sensor signal indicating that the semiconductor wafer W is out of position. When the sensor coil 202 is positioned beneath the semiconductor wafer W, the film thickness measuring main unit 200*b* receives a sensor signal whose magnitude level depends on an eddy current generated in the conductive film 201'. After the semiconductor wafer W has passed over the sensor coil 202, the film thickness measuring main unit 200*b* receives a signal whose magnitude level indicates that no eddy current is induced.

The film thickness measuring main unit 200*b* keeps the sensor coil 202 activated for sensing at all times. However, if the film thickness of the conductive film 201' on the semiconductor wafer W is directly measured, the magnitude level of the sensor signal is changed as the film thickness is changed due to the polishing process, thus causing the measurement timing to become unstable. In order to avoid such a drawback, the polishing liquid supply nozzle 102 (see FIG. 2) supplies water to perform a water polishing on a dummy wafer serving as a reference wafer so as to acquire a magnitude level of a signal at a time of starting measurement of the semiconductor wafer W. For example, a reference wafer having a Cu layer of 1000 nm thickness is polished with water for 120 seconds by the polishing table 100 which is rotated at 60 revolutions per minute. Specifically, an intermediate value between the upper and lower magnitude levels, which are obtained after receiving the signal from the dog sensor 350 and represent the presence and absence of the semiconductor wafer, is used as a magnitude level which indicates the arrival of the peripheral edge of the semiconductor wafer W (hereinafter referred to as an arrival determination level). Therefore, when the magnitude level exceeds the arrival determination level after receiving the signal from the dog sensor 350, the sensor signals are acquired in every 1 millimeter second (msec.). The acquisition of the sensor signals is finished when the semiconductor wafer W leaves the position above the sensor coil 202. The acquired sensor signals are converted into physical dimensions and assigned to the respective zones of the semiconductor wafer W.

Figure 19A:
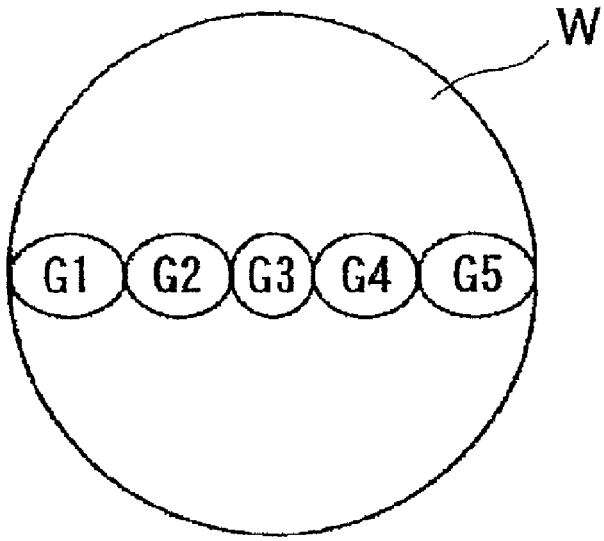
FIGS. 19A and 19B are schematic views illustrating a concept of polishing a substrate with the substrate polishing apparatus.
Figure 19B:
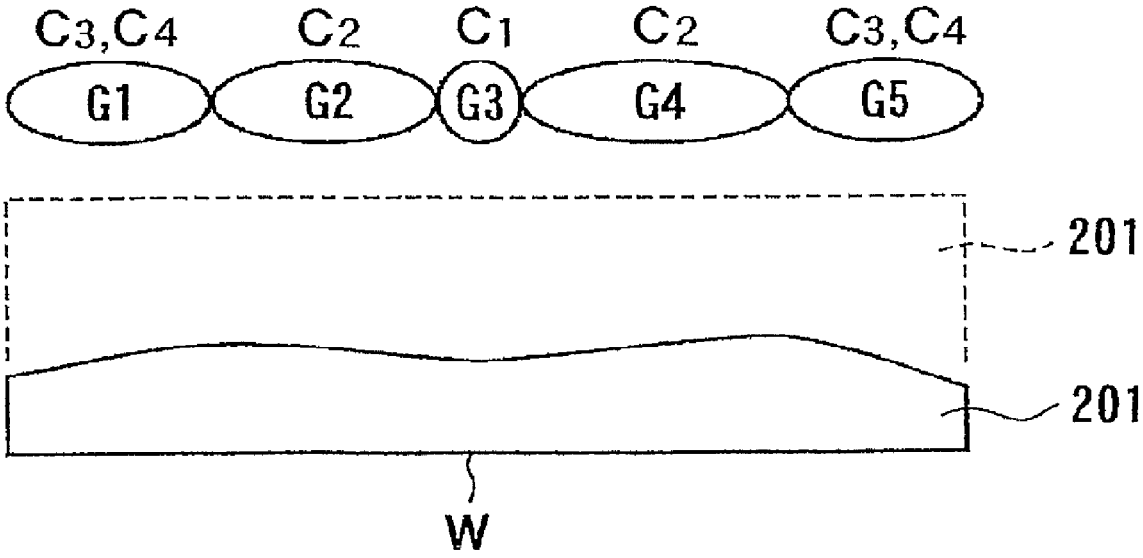

As shown in FIG. 19A, if the path R (see FIG. 17) on the semiconductor wafer W is straightened, then the sensor signals received by the film thickness measuring main unit 200*b* can be assigned to the central zone (C1 in FIG. 4) through the peripheral zone (C4) of the semiconductor wafer W. As shown in FIG. 19B, the thicknesses of the central zone (C1), the intermediate zone (C2), and the peripheral zone (C3, C4), which are three divided zones of the conductive film 201 on the semiconductor wafer W, can be measured before, during, and after the polishing process. The sensor signals in the respective zones are calculated, e.g., averaged, and the calculated values are used as measured values of the respective zones.

The semiconductor wafer W has an outermost peripheral region where the conductive film 201' is not formed. Therefore, a so-called edge-cutoff process is performed to discard the sensor signals corresponding to the outermost circumferential region. In the present embodiment, the semiconductor wafer W is divided into three zones, and the measurement is performed at five regions G1 to G5 so as to acquire measured values at the respective regions G1 to G5, as shown in FIG. 19B. However, the semiconductor wafer W may be divided into four zones C1 to C4 where the pressing forces are adjustable so that measured values are acquired and controlled in the respective seven regions. The surface, to be polished, of the semiconductor wafer W may be divided into more zones or less zones.

Figure 20:
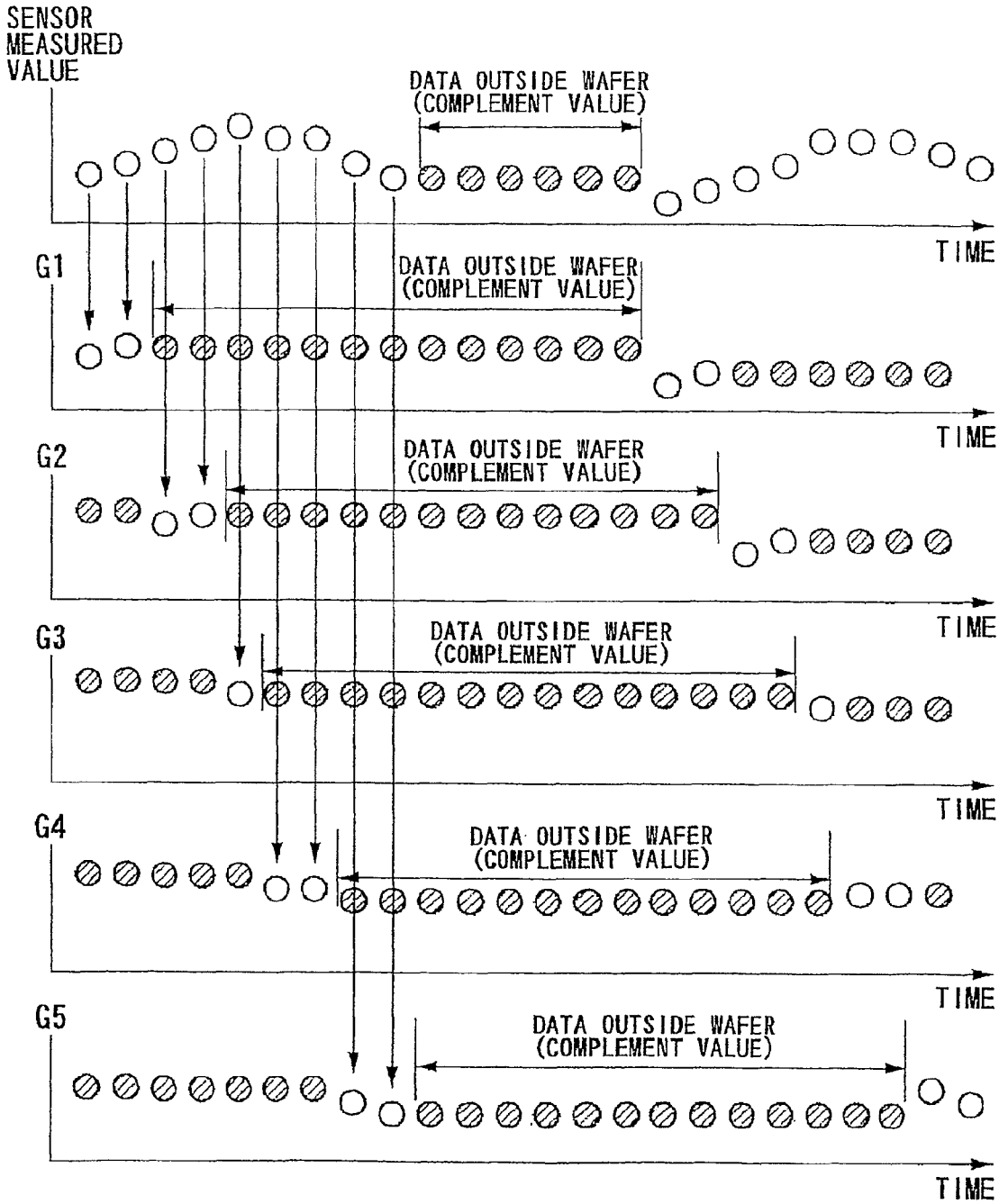
FIG. 20 is graph illustrating sensor signals of the film thickness measuring device of the substrate polishing apparatus.

As shown in FIG. 20, the acquired sensor signals are assigned to the regions G1 to G5, respectively. Specifically, the number of sensor signals to be assigned to each region is calculated based on the each region width, and then the measured values (sensor signals) are assigned to the respective regions G1 to G5. For example, two measured values are assigned to the region G1 corresponding to the peripheral zones (C3, C4), two measured values are assigned to the region G2 corresponding to the intermediate zone (C2), one measured value is assigned to the region G3 corresponding to the central zone (C1), two measured values are assigned to the region G4 corresponding to the intermediate zone (C2), and finally two measured values are assigned to the region G5 corresponding to the peripheral zones (C3, C4).

The film thickness measuring main unit 200*b* measures the thickness of the conductive film 201' each time the coil sensor 202 sweeps across the semiconductor wafer W based on the measured values acquired in each of the regions G1 to G5, and displays the thicknesses of the regions G1 to G5 of the conductive film 201' on a display device incorporated in the film thickness measuring main unit 200*b*. Therefore, as shown in FIG. 20, the complement data (values) are generated and displayed on the display device, instead of displaying the unnecessary measured values which are acquired when the coil sensor 202 is positioned out of the semiconductor wafer W and the regions R1 to G5. The complement data (values) are displayed on the assumption that the conductive film 201' is present in order not to cause the displayed data to vary largely. Therefore, the complement data (values) are calculated from the following equation using the preset number of effective nearby measured values:

Complement value=[measured maximum value−measured minimum value]×coefficient (conversion ratio %)−measured minimum value Film thickness data are acquired according to a batch process in which the film thickness is measured only when the eddy current sensor (the sensor coil 202) and the semiconductor wafer W face each other each time the polishing table 100 makes one revolution. The signal from the eddy current sensor, which varies depending on a change in the film thickness to be measured, may be produced by synchronously adding a plurality of data successively measured in every 10 μsec to 100 μsec (e.g., 100 μsec) by an external synchronous A/D converter supplied with the signal from the dog sensor 350. For example, ten successive data obtained in every 100 μsec from the dog sensor 350 are added and averaged to use obtained data as date per 1 msec. By adding and averaging the measured data, noise contained in the data can be reduced.

Figure 21:
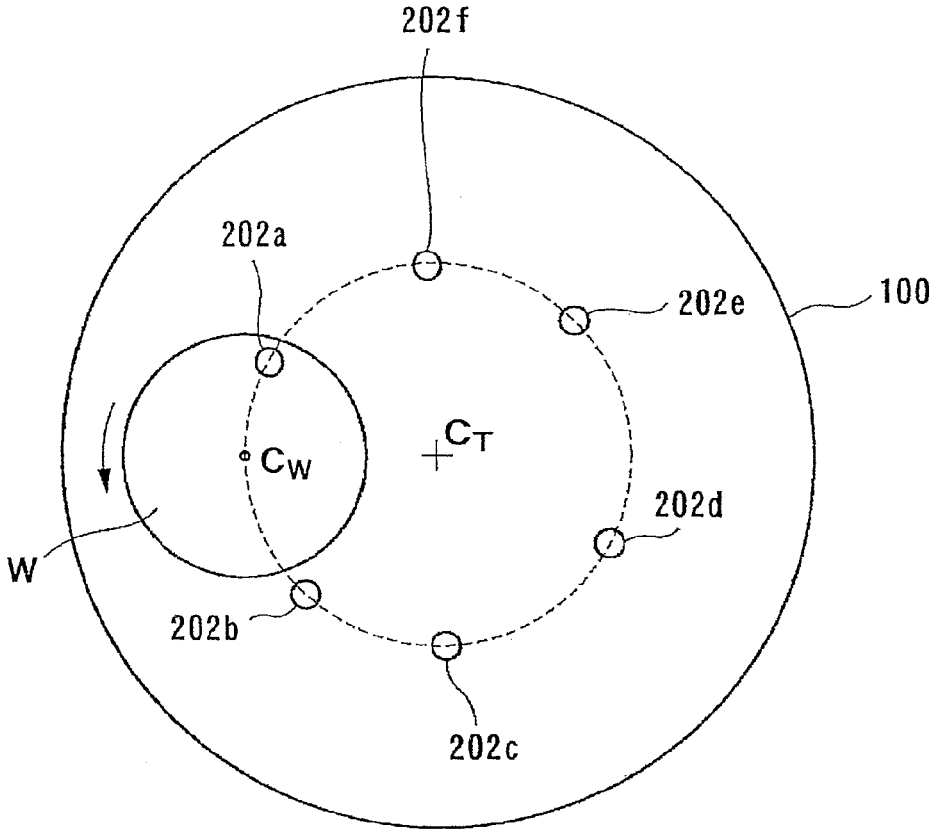
FIG. 21 is a plan view illustrating the manner in which the substrate polishing apparatus is operated.

FIG. 21 shows another embodiment of the polishing table 100 illustrated in FIG. 16. As shown in FIG. 21, sensor coils 202*a* to 202*f* are disposed at positions, i.e., six positions in this embodiment, where the center Cw of the semiconductor wafer W held by the top ring 1 passes across during polishing. A reference sign Ct represents a rotational center of the polishing table 100. The sensor coils 202*a* to 202*f* measure a thickness of a conductive film such as a Cu layer or a barrier layer on the semiconductor wafer W when the sensor coils 202*a* to 202*f* sweep across the central zone (C1 in FIG. 4) of the semiconductor wafer W, the intermediate zone (C2), the outer zone (C3), and the peripheral zone (C4). In this manner, the sensor coils 202*a* to 202*f* can measure thicknesses of the respective zones C1 to C4 successively without waiting the polishing table 100 to make one revolution. Specifically, the eddy current sensor (film thickness measuring device) 200 has the sensor coils (measuring devices) 202*a* to 202*f* which can measure the film thicknesses of the divided zones C1 to C4 where the pressing forces against the semiconductor wafer W are adjustable. Frequencies of the sensor coils 202*a* to 202*f* may be different from each other so that the sensor coils 202*a* to 202*f* detect a change in the thickness of the barrier layer with use of a high frequency and detect a change in the film thickness of the Cu layer with use of a low frequency.

While the sensor coils 202*a* to 202*f* are disposed at six positions in this embodiment, the number of sensor coils may be changed. Further, although the polishing pad is mounted on the polishing table 100 in this embodiment, a fixed abrasive plate may be used. In this case, the sensor coils are disposed in the fixed abrasive plate.

The substrate polishing apparatus having the above structure is operated as follows: The semiconductor wafer W is held on the lower surface of the top ring 1, and pressed by the top ring air cylinder 111 against the polishing pad 101 mounted on the upper surface of the polishing table 100 which is rotating. The polishing liquid Q is supplied from the polishing liquid supply nozzle 102 onto the polishing pad 101, and is thus held by the polishing pad 101. The semiconductor wafer W is polished with the polishing liquid Q being present between the surface (lower surface) of the semiconductor wafer W and the polishing pad 101.

While the semiconductor wafer W is being polished, the sensor coils 202*a* to 202*f* pass across the lower surface of the semiconductor wafer W each time the polishing table 100 makes one revolution. Since the sensor coils 202*a* to 202*f* are disposed on the path of the center Cw of the semiconductor wafer W, the sensor coils 202*a* to 202*f* can successively measure the thickness of the film. As the sensor coils 202*a* to 202*f* are installed in the six positions, any one of the sensor coils 202*a* to 202*f* can detect the polishing state intermittently in a short period of time.

Figure 22A:
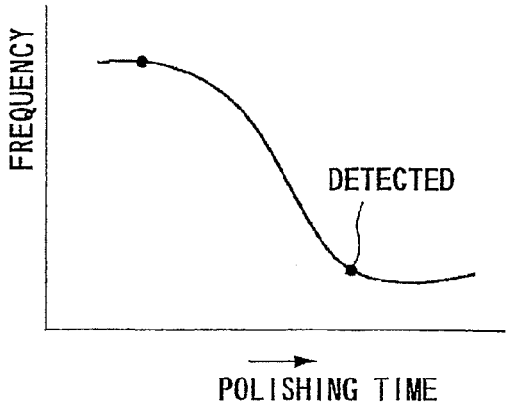
FIGS. 22A and 22B are graphs illustrating sensor signals of the film thickness measuring device of the substrate polishing apparatus.
Figure 22B:
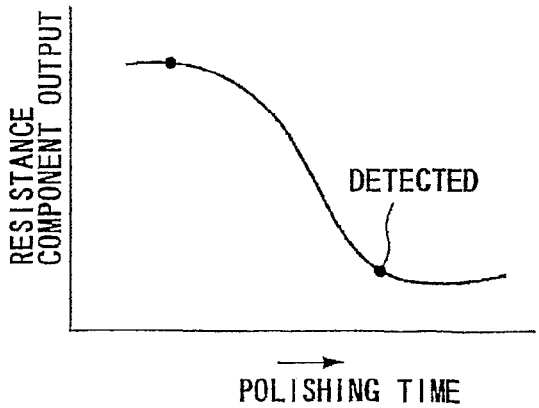

As shown in FIGS. 22A and 22B, as the polishing process proceeds, the measured values which are processed by the film thickness measuring main unit 200*b* from the signals of the sensor coils 202*a* to 202*f* are gradually reduced. Specifically, as the thickness of the conductive film is reduced, the measured values which are processed by the film thickness measuring main unit 200*b* are gradually reduced with time. Therefore, if values obtained at a point of time when the conductive film is removed from a necessary area other than the interconnects are checked in advance, an end point of the CMP process can be detected by monitoring the measured values outputted from the film thickness measuring main unit 200*b*.

Figure 23:
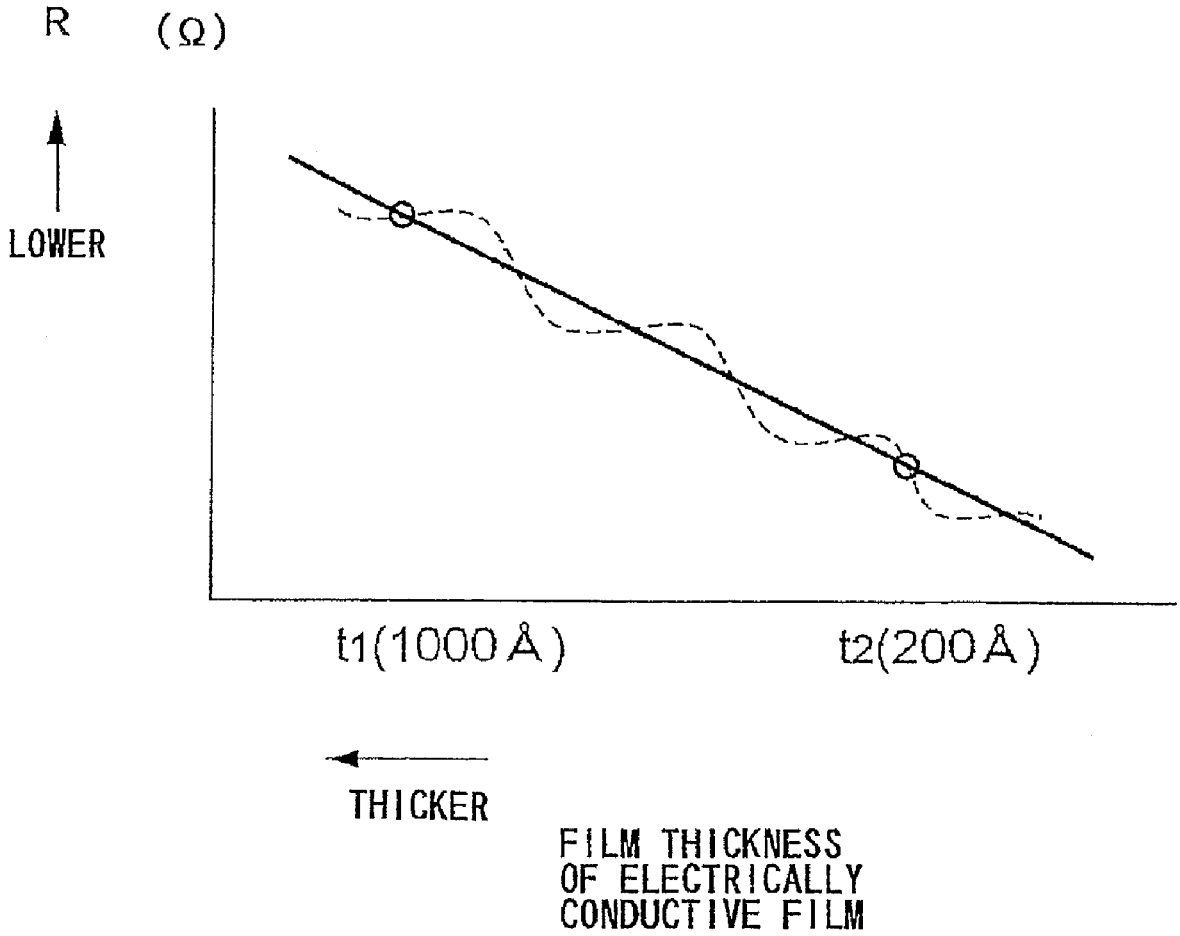
FIG. 23 is a graph illustrating an output signal of the film thickness measuring device of the substrate polishing apparatus.

FIG. 23 shows an example of a calibrated relationship between a film thickness and a resistance component. Reference wafers having thicknesses of 1000 Å ($t_1$) and 200 Å ($t_2$), respectively, are prepared, and resistance components of the respective reference wafers are measured so as to use as reference points. Thereafter, the actual polishing process is performed, and data showing a relationship between the film thickness and the resistance component are acquired as indicated by the dotted-line curve in FIG. 23. A reactance component, an impedance (amplitude), or a phase may be measured instead of the resistance component. The acquired data are processed by a method of least squares with respect to the reference points, and processed data are plotted to form a curve. In this manner, the characteristics of the eddy current sensor are calibrated by the above process and then stored. Accordingly, the measured value can appropriately be amplified or offset, so that the change in the film thickness can accurately be read from the change in the measured value without being affected by the difference between individual units of the eddy current sensors.

The substrate polishing apparatus having a number of such eddy current sensors is capable of detecting an end point over the entire surface of the semiconductor wafer in a short period of time. The end point of the polishing process on a barrier layer such as a Ta layer, a TaN layer, or a TiN layer can be detected with a high accuracy. Even if a patch (an unremoved metal) of the conductive film remains in the final stage of the polishing process, the eddy current sensor of the above structure can detect such a remaining patch, as long as the remaining patch has a diameter of not less than 5 mm and a gap between the polished surface of the semiconductor wafer and the upper end of the sensor coil is not more than 3.5 mm. The detected patch can thus reliably be polished and removed in the polishing process. Even if multilayered interconnects of conductive material are formed on the semiconductor wafer, the eddy current sensor of the above structure can detect such interconnects of the conductive material in the surface layer, as long as the interconnects have a density of not more than 90%.

In a case where a polishing mode is required to be switched to another when a film thickness is reduced to a predetermined value, the preamplifier or the main amplifier is initially set to have a gain range such that the film thickness measuring main unit 200*b* can measure a film thickness on the order of angstroms for enabling an accurate confirmation of the predetermined film thickness. For example, in a case of polishing a tungsten (W) layer, if the polishing mode is required to be switched when a film thickness reaches about 300 Å, the amplifier is set to have an overrange (saturated range) in which the film thickness cannot be measured as long as the tungsten layer has a thickness of 300 Å or more. Therefore, when the tungsten layer is polished to a thickness of less than 300 Å, linear characteristics of the amplifier can be obtained.

Figure 24A:
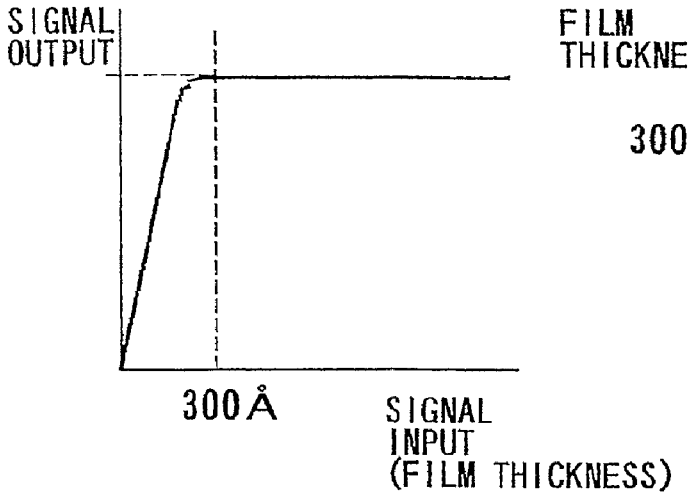
FIGS. 24A through 24C are graphs showing sensor signals of the film thickness measuring device of the substrate polishing apparatus.
Figure 24B:
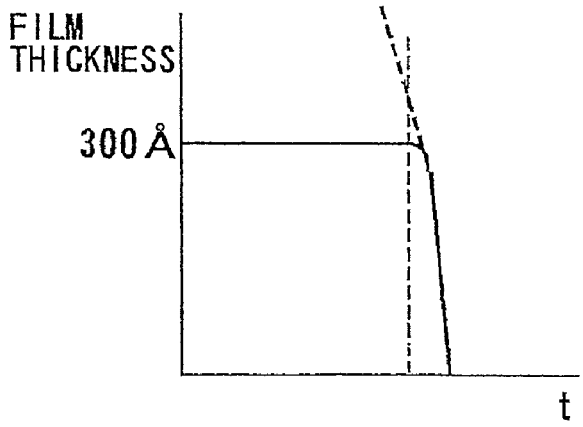
Figure 24C:
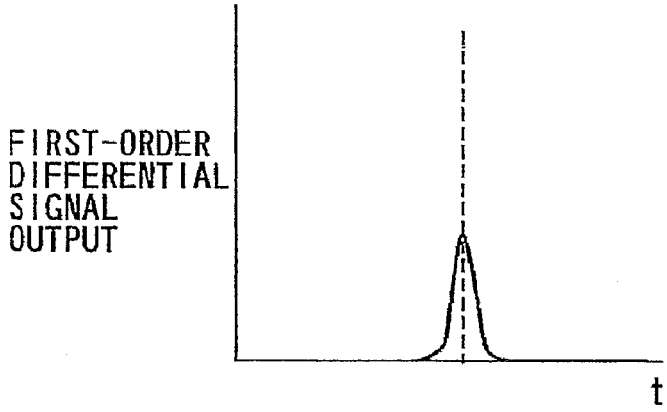

Specifically, as shown in FIG. 24A, a gain of an amplifier is set such that its output signal is saturated when an input signal represents a thickness of 300 Å or more. For example, when the polishing of the tungsten layer proceeds as indicated by the dotted-line in FIG. 24B, the output signal of the amplifier is saturated and thus constant in magnitude as long as the tungsten layer has a thickness of 300 Å or more as indicated by the solid-line. When the film thickness is reduced to less than 300 Å, the amplifier is operated linearly, and hence its output signal drops as indicted by the solid-line. By calculating a first-order differential of the output signal of the amplifier, as shown in FIG. 24C, it is possible to clearly detect a point of time when the film thickness reaches 300 Å.

Based on the above measured values, the operation mode (recipe) of the substrate polishing apparatus can be switched to a mode for polishing the barrier layer, thus enabling a highly accurate polishing process. The operation mode (recipe) of the eddy current sensor is also changed in oscillation frequency or amplification for thereby reliably determining whether a barrier layer having a very small thickness is present or not. Therefore, an end point of the polishing process can be determined accurately.

As described above, the film thicknesses of the central zone (C1 in FIG. 4), the intermediate zone (C2), the outer zone (C3), and the peripheral zone (C4) of the semiconductor wafer W are measured by the film thickness measuring devices 200 and 200' such as a microwave sensor or an eddy current sensor. These measured values are sent to the controller 400 (see FIG. 2) of the substrate polishing apparatus. The controller 400 controls the regulators RE3 to RE6 to independently regulate the pressures of the pressurized fluids supplied to the pressure chambers 22 to 25 in the top ring 1 based on the measured values, thereby optimizing the pressing forces applied respectively to the zones C1 to C4 of the semiconductor wafer W when being pressed against the polishing pad 101 on the polishing table 100.

In this manner, in order to optimize the pressing forces applied to the respective zones C1 to C4 of the semiconductor wafer W, the film thickness measuring devices 200 and 200' transmit the measured values of the film thickness of the conductive film 201 to the controller 400. On the other hand, the controller 400 generates command signals to be sent to the film thickness measuring devices 200 and 200' based on the measured values of the film thickness. The film thickness measuring devices 200 and 200' switch the operation mode according to the command signals from the controller 400. Specifically, the film thickness measuring devices 200 and 200' select parameters suitable for the type of film or multilayer film to be measured, and process sensor signals using the selected parameters to measure the film thickness.

In the present embodiment, a film on the semiconductor wafer is removed by a CMP polishing. However, an etching process, an electrolytic polishing process, and an ultrapure water electrolytic polishing process may be employed. In these processes also, as with the CMP polishing, a thickness of a film to be removed may be measured to control a process. A thickness of a film may be measured in a film forming process to control the process, rather than the film removing process.

An electromagnetic field of an eddy current sensor (whose oscillation frequency is selected from 2 MHz, 8 MHz, 20 MHz, and 160 MHz) or an electromagnetic wave having a frequency ranging from 30 GHz to 300 GHz may be applied to a waste slurry on the polishing pad or a waste reaction slurry to produce a demagnetizing field or a reflected wave so that an amplitude of the demagnetizing field, an amplitude of the reflected wave, and a change in impedance of the reflected wave may be measured. The measured impedance may be compared with reference impedance which has been obtained before the polishing process is performed, or a change in time differential of the impedance may be observed. By such comparison and observation, it is possible to detect an end point and a failure of the polishing process. The observation of the waste liquid or the reaction liquid with use of the eddy current sensor or the electromagnetic wave may also be employed to monitor a processing liquid, such as an electrolytic solution or ultrapure water, used in a film forming process and a film removing process that are performed by a plating apparatus, an ultrapure water electrolytic polishing apparatus, an electroless plating apparatus, and an electrolytic polishing apparatus.

According to the present invention, the pressing force with which the substrate is pressed against the polishing surface of the polishing table can be regulated in various zones of the substrate according to the film thicknesses in the respective zones. Accordingly, the respective zones of the substrate can be polished at different polishing rates, and hence the thickness of the film on the substrate can be adjusted highly accurately. By using the eddy current sensor or the microwave sensor as a device for measuring the thickness of the film on the substrate, it is not necessary to form an opening in the polishing surface of the polishing table, and hence the film thicknesses of the respective zones of the substrate can be easily measured and the substrate can be polished highly accurately at a low cost.

Although certain preferred embodiments of the present invention have been shown and described in detail, it should be understood that various changes and modifications may be made therein without departing from the scope of the appended claims.

INDUSTRIAL APPLICABILITY

The present invention is applicable to a substrate polishing apparatus and a substrate polishing method for polishing a substrate such as a semiconductor wafer to a flat finish.

The invention claimed is:

1. A substrate polishing apparatus, comprising:

a polishing table having a polishing surface;

a substrate holder configured to hold a substrate and press the substrate against said polishing surface of said polishing table; said substrate holder including a controller that is configured to press multiple zones of the substrate against said polishing surface of said table at predetermined pressing forces; and an eddy current sensor configured to measure a thickness of a film formed on the substrate, said eddy current sensor having an amplifier, a gain of said [eddy current sensor] amplifier being set such that an output signal of said [eddy current sensor] amplifier is saturated when the thickness of the film is equal to or more than a predetermined thickness, and once the thickness is reduced to less than the predetermined thickness, the output signal of said amplifier drops, wherein said substrate holder adjusts the pressing forces based on the measurement information.

2. The substrate polishing apparatus according to claim 1, wherein the predetermined thickness is 300Å.

3. The substrate polishing apparatus according to claim 1, wherein:

[said substrate holder is configured to press multiple zones of the substrate against said polishing surface of said polishing table at predetermined pressing forces;]

said eddy current sensor has a sensor coil that is moved across the substrate;

said eddy current sensor is configured to obtain time-series measured values during movement of said sensor coil and assign the time-series measured values to the multiple zones of the substrate to provide the measurement information indicating thicknesses of the film in the multiple zones; and said substrate holder [is further configured to adjust] adjusts the pressing forces based on the measurement information provided by said eddy current sensor.

4. The substrate polishing apparatus according to claim 3, wherein the substrate has a tungsten film and a copper film formed on the tungsten film, and said eddy current sensor is configured to detect a point of time when a thickness of the tungsten film reaches the predetermined thickness based on a first-order differentiated value of a measured film thickness obtained by said eddy current sensor.

5. A method of polishing a film of a substrate by pressing the substrate against a polishing surface of a polishing table, said method comprising:

providing a substrate holder, substrate holder being configured to hold the substrate and press the substrate against the polishing surface of the polishing table , the substrate holder includinq a controller that is configured to press multiple zones of the substrate against the polishing surface of the polishing table at predetermined pressing forces;

providing an eddy current sensor, the eddy current sensor configured to measure the thickness of the film formed on the substrate, wherein the eddy current sensor has an amplifier;

setting a gain of [an eddy current sensor] the amplifier such that an output signal of the [ eddy current sensor] amplifier is saturated when a thickness of the film is equal to or more than a predetermined thickness;

measuring the thickness of the film using the eddy current sensor; and detecting a point of time when the thickness of the film reaches the predetermined thickness, wherein once the thickness is reduced to less than the predetermined thickness, the output signal of the amplifier drops, and the substrate holder adjusts the pressing forces based on the measurement information.

6. The method according to claim 5, wherein the predetermined thickness is 300Å.

7. The method according to claim 5, wherein:

the substrate has a tungsten film and a copper film formed on the tungsten film; and said detecting a point of time when the thickness of the film reaches the predetermined thickness comprises detecting a point of time when a thickness of the tungsten film reaches the predetermined thickness based on a first-order differentiated value of a measured film thickness obtained by the eddy current sensor.

* * * * *

UNITED STATES PATENT AND TRADEMARK OFFICE

CERTIFICATE OF CORRECTION

PATENT NO. : 7,854,646 B2
APPLICATION NO. : 12/688021
DATED : December 21, 2010
INVENTOR(S) : Tetsuji Togawa et al.

It is certified that error appears in the above-identified patent and that said Letters Patent is hereby corrected as shown below:

In column 30, claim 1, lines 65-66, please delete "[eddy current sensor]".

In column 30, claim 1, lines 67, please delete "[eddy current sensor]".

In column 31, claim 3, lines 11-13, please delete "[said substrate holder is configured to press multiple zones of the substrate against said polishing surface of said polishing table at predetermined pressing forces;]".

In column 31, claim 3, line 22, please delete "[is further configured to adjust]".

In column 32, claim 5, line 12, please delete "[an eddy current sensor]".

In column 32, claim 5, line 13, please delete "[ eddy current sensor]".

Signed and Sealed this
Fifteenth Day of March, 2011

David J. Kappos

David J. Kappos
*Director of the United States Patent and Trademark Office*